US009095859B2

(12) United States Patent
Sesser et al.

(10) Patent No.: US 9,095,859 B2
(45) Date of Patent: Aug. 4, 2015

(54) MULTI-NOZZLE SHUTTLE FOR A SPRINKLER HEAD

(71) Applicant: Nelson Irrigation Corporation, Walla Walla, WA (US)

(72) Inventors: George L. Sesser, Walla Walla, WA (US); Meade M. Neal, Walla Walla, WA (US); Craig M. Nelson, Walla Walla, WA (US); Barton R. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 234 days.

(21) Appl. No.: 13/776,051

(22) Filed: Feb. 25, 2013

(65) Prior Publication Data

US 2013/0320108 A1 Dec. 5, 2013

Related U.S. Application Data

(60) Provisional application No. 61/654,322, filed on Jun. 1, 2012.

(51) Int. Cl.

| | |
|---|---|
| ***B05B 1/16*** | (2006.01) |
| ***B05B 3/02*** | (2006.01) |
| ***B05B 1/26*** | (2006.01) |

(52) U.S. Cl.

CPC ..... *B05B 1/16* (2013.01); *B05B 1/1645* (2013.01); *B05B 1/262* (2013.01); *B05B 3/02* (2013.01); *B05B 1/1663* (2013.01)

(58) Field of Classification Search

CPC ..... B05B 1/16; B05B 1/1645; B05B 1/1663; B05B 1/262; B05B 3/02

USPC ..... 169/37, 41, 90; 239/214, 222.11, 461, 239/600, 391, 392, 393, 397

See application file for complete search history.

(56) References Cited

U.S. PATENT DOCUMENTS

| | | | | |
|---|---|---|---|---|
| 141,620 | A * | 8/1873 | Barton | 239/393 |
| 155,020 | A | 9/1874 | Gassett et al. | |
| 979,771 | A | 12/1910 | Kunzelmann, Sr. | |
| 2,060,943 | A | 11/1936 | Lieb | |
| 2,281,229 | A | 4/1942 | Bullock | |

(Continued)

FOREIGN PATENT DOCUMENTS

| | | |
|---|---|---|
| EP | 2 551 022 | 1/2013 |
| GB | 8713 | 0/1897 |

OTHER PUBLICATIONS

U.S. Appl. No. 13/556,324, filed Jul. 24, 2012 (pending).

(Continued)

*Primary Examiner* — Justin Jonaitis
(74) *Attorney, Agent, or Firm* — Nixon & Vanderhye P.C.

(57) ABSTRACT

A sprinkler head includes a sprinkler body having an inlet bore at one end, and a coupling element at an opposite end adapted to connect the sprinkler body to a water deflector plate. A multi-nozzle shuttle supports at least two nozzles and is attached to the sprinkler body axially between the inlet bore and the coupling element for swinging pivotal movement between two nozzle-installed positions. The multi-nozzle shuttle may also be provided with a shut-off surface portion for shutting off flow through the sprinkler body when the multi-nozzle shuttle is moved to a shut-off position. The shuttle may be moved manually or by a power actuator.

27 Claims, 26 Drawing Sheets

(56) References Cited

U.S. PATENT DOCUMENTS

| | | | | |
|---|---|---|---|---|
| 2,918,200 | A | 12/1959 | Libit et al. | |
| 4,801,089 | A | 1/1989 | Zeman | |
| 5,234,169 | A | 8/1993 | McKenzie | |
| 5,253,807 | A | 10/1993 | Newbegin | |
| 5,335,859 | A | 8/1994 | Thayer et al. | |
| 5,411,350 | A | 5/1995 | Breault | |
| 5,456,411 | A | 10/1995 | Scott et al. | |
| 5,487,507 | A | 1/1996 | McDonald et al. | |
| 5,560,548 | A | 10/1996 | Mueller et al. | |
| 5,699,962 | A | 12/1997 | Scott et al. | |
| 5,727,739 | A | 3/1998 | Hamilton | |
| 5,762,269 | A * | 6/1998 | Sweet | 239/71 |
| 5,884,847 | A | 3/1999 | Christopher | |
| 6,234,411 | B1 | 5/2001 | Walker et al. | |
| 6,244,527 | B1 | 6/2001 | Ferrazza et al. | |
| 6,398,128 | B1 | 6/2002 | Hamilton et al. | |
| 6,405,902 | B2 | 6/2002 | Everett | |
| 6,447,027 | B1 | 9/2002 | Lilley et al. | |
| 6,669,120 | B2 | 12/2003 | Vernia | |
| 6,676,038 | B2 | 1/2004 | Gressett, Jr. et al. | |
| 6,749,134 | B2 | 6/2004 | Arenson et al. | |
| 6,772,964 | B2 | 8/2004 | Funseth et al. | |
| 6,871,795 | B2 | 3/2005 | Anuskiewicz | |
| 6,880,768 | B2 | 4/2005 | Lau | |
| 7,431,346 | B2 | 10/2008 | Frost et al. | |
| 7,472,840 | B2 | 1/2009 | Gregory | |
| 7,644,877 | B2 | 1/2010 | Drechsel | |
| 7,980,490 | B2 | 7/2011 | Waddelow et al. | |
| 2004/0217196 | A1 | 11/2004 | Yurek, Jr. et al. | |
| 2007/0131792 | A1 | 6/2007 | Gardner et al. | |
| 2009/0200796 | A1 | 8/2009 | Lai | |
| 2009/0321543 | A1 * | 12/2009 | Lawyer et al. | 239/600 |
| 2010/0025983 | A1 | 2/2010 | Rosch et al. | |
| 2010/0102149 | A1 * | 4/2010 | Lawyer et al. | 239/722 |
| 2010/0108783 | A1 | 5/2010 | Joseph et al. | |
| 2010/0301130 | A1 | 12/2010 | Townsend | |
| 2012/0312898 | A1 | 12/2012 | Sesser et al. | |
| 2013/0026254 | A1 * | 1/2013 | Sesser et al. | 239/395 |

OTHER PUBLICATIONS

U.S. Appl. No. 13/490,534, filed Jun. 7, 2012 (pending).

U.S. Appl. No. 13/626,472, filed Sep. 25, 2012 (pending).

European Search Report dated Oct. 29, 2013 issued in European Patent Application No. 13169979.5, 7 pp.

* cited by examiner

MULTI-NOZZLE SHUTTLE FOR A SPRINKLER HEAD

Priority is hereby claimed from Provisional Application Ser. No. 61/654,322 filed in the United States Patent and Trademark Office on Jun. 1, 2012, the entirety of which is incorporated herein by reference.

BACKGROUND

This invention relates to sprinkler heads primarily used in, but not limited to, agricultural applications, and specifically, to a side-load, multi-nozzle shuttle for such sprinkler heads.

For most rotary type sprinkler heads where a stream of water from a fixed nozzle impinges on a rotatable water deflector plate, the nozzle is removable and interchangeable with nozzles of different size, i.e., nozzles with different orifice diameters. Reasons for changing the nozzle size include varying flow rates based on factors such as weather, crop to be irrigated, crop maturity, soil moisture, soil type, etc. Flow rates may also be varied for specific events such as "chemigation" where a chemical or fertilizer is added to the water for a limited period of time. Typically, however, in order to remove and replace the nozzle, the water supply must be shut off and the sprinkler head at least partially disassembled. It is also oftentimes desirable to simply shut off one or more of the many sprinklers mounted on, for example, a truss span of a linear or center-pivot irrigator, in order to provide a desired sprinkling pattern based on one or more of the factors mentioned above. For a large irrigation system with, for example, more than one hundred sprinklers located on a single-truss span, this can be a very time-consuming process.

While there have been proposed solutions to the disassembly problem using various, fairly complex multi-nozzle turret arrangements for selectively installing nozzles of different size, the lack of simple and reliable nozzle-change and shut-off features in a rotary sprinkler head can be problematic. It would therefore be desirable to have a quick-change nozzle system that facilitates a manual nozzle change-out process, or where appropriate, an automatic nozzle change-out process that may be operated remotely to control some or all of the individual sprinklers on a linear or center-pivot irrigation truss span (or other irrigation system) in accordance with a predetermined or site-specific irrigation program.

BRIEF SUMMARY OF THE INVENTION

The present invention seeks to overcome the problems associated with prior nozzle-change mechanisms and/or sprinkler head shut-off arrangements. Specifically, one exemplary but nonlimiting sprinkler head described herein is provided with a manually-operated multi-nozzle shuttle pivotably mounted on the sprinkler head body for pivotal or swinging movement between either of two nozzle-installed positions and, optionally, a nozzle shut-off position. Advantageously, the shut-off position, if used, is located between the two nozzle-installed positions along an arcuate path of movement of the shuttle.

In addition, the nozzles are easily removed from the shuttle when the respective nozzles are in a non-installed or inoperative position.

Other features include releasable retention (resilient or substantially rigid) of the shuttle in any of its three positions as well as easily-seen identifiers indicating the orifice size or general flow rate (e.g., "HI" or "LO") of the nozzle that is in the installed position.

Accordingly, in a first exemplary but nonlimiting embodiment, the invention described herein provides a sprinkler head comprising a sprinkler body having a first flow passage defined by a bore having an inlet end and an outlet end; and a multi-nozzle shuttle supporting at least two nozzles and provided with openings aligned with second flow passages in the at least two nozzles, respectively; the multi-nozzle shuttle mounted on the sprinkler body for swinging pivotal movement between either of two nozzle-installed positions wherein one of the second flow passages in a selected one of the at least two nozzles is aligned with the first flow passage at the outlet end of the bore.

In another aspect, there is provided a sprinkler head comprising a sprinkler body having a first flow passage defined by a bore having an inlet end and an outlet end; a multi-nozzle shuttle including a nozzle support platform supporting a pair of nozzles on one side of the nozzle support platform, the multi-nozzle shuttle supported on the sprinkler body for pivoting movement in one direction to a first nozzle-installed position where one of the pair of nozzles is aligned with the flow passage, and in an opposite direction to a second nozzle-installed position where the other of the pair of nozzles is aligned with the flow passage.

In still another aspect, there is provided a sprinkler head comprising a sprinkler body having a center hub having a first flow passage defined by a bore having an inlet end and an outlet end; a multi-nozzle shuttle adapted to support a pair of nozzles, the multi-nozzle shuttle supported on the center hub for swinging pivotal movement about a horizontal axis between a nozzle shut-off position and either of two nozzle-installed positions, the shuttle provided with a nozzle support platform formed with a shut-off surface on an upper side of the nozzle support platform for shutting off flow through the bore when the multi-nozzle shuttle is moved to the nozzle shut-off position; a pair of nozzle holders on an underside of the nozzle support platform; and a pair of positioning arms projecting below the nozzle support platform, the pair of positioning arms each formed on respective lower edges with three notches corresponding to the nozzle shut-off position and the two nozzle-installed positions, the three notches on each positioning arm adapted for selective engagement with a retention tab located on opposite sides of the sprinkler body.

In another exemplary but nonlimiting embodiment, the invention also provides a sprinkler head comprising a sprinkler body having a center hub including a first nozzle-installed flow passage defined by a bore having an inlet end and an outlet end; a multi-nozzle shuttle attached to the sprinkler body supporting first and second nozzles located downstream of the bore for swinging pivotal movement between at least a first nozzle-installed position where the first nozzle is aligned with the bore and a second nozzle-installed position where the second nozzle is aligned with the bore; and a power actuator arranged to move the multi-nozzle shuttle between at least the first nozzle-installed position and the second nozzle-installed position.

In still another exemplary but nonlimiting embodiment, the invention relates to an irrigation system comprising a plurality of sprinkler heads on an irrigation apparatus and independently controlled by a controller, each sprinkler head comprising a sprinkler body formed with a first flow passage defined by a bore having an inlet end and an outlet end; a multi-nozzle shuttle attached to the sprinkler body supporting first and second nozzles located downstream of the bore for swinging pivotal movement between at least a first nozzle-installed position where the first nozzle is aligned with the bore and a second nozzle-installed position where the second nozzle is aligned with the bore; and a power actuator connected between the sprinkler head and the multi-nozzle shuttle, the power actuator and an associated control valve operatively connected to the controller, the power actuator adapted to move the multi-nozzle shuttle between at least the first nozzle-installed position and the second nozzle-installed position in response to a command received from the controller.

In all cases, the sprinkler body may include coupling features at an end of the body downstream of the multi-nozzle shuttle for attaching a water deflector plate adapted to be impinged upon by a stream emitted from the selected nozzle.

The invention will now be described in greater detail in connection with the exemplary drawings identified below.

DETAILED DESCRIPTION OF THE INVENTION

Figure 1:
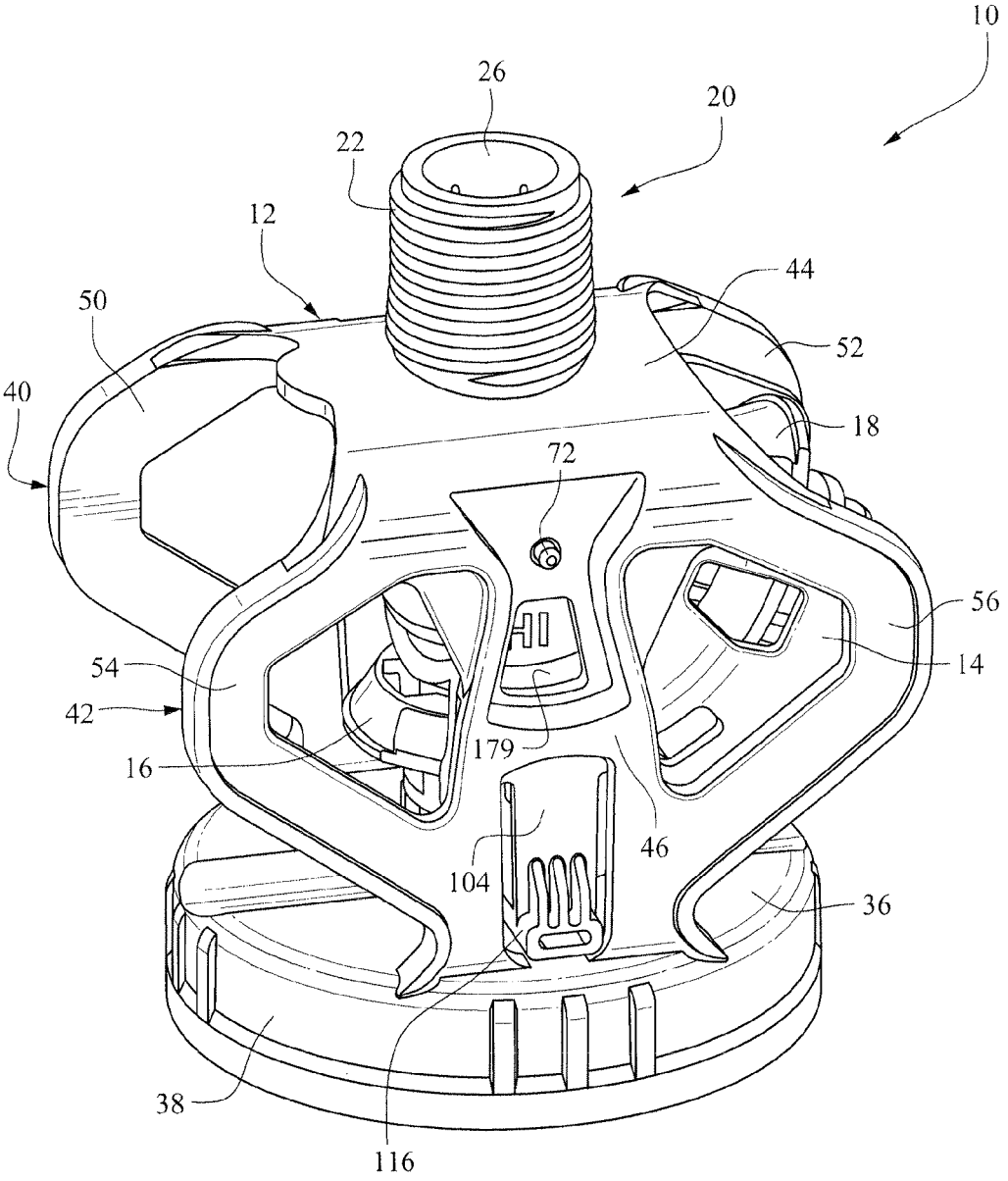
FIG. 1 is a top, front, right perspective view of a sprinkler head formed with a side-load, multi-nozzle shuttle in accordance with the exemplary but nonlimiting embodiment of the invention showing one of two nozzles in a nozzle-installed position.

FIG. 1 illustrates a sprinkler head 10 which includes a body 12 that supports a multi-nozzle shuttle 14 configured to support a pair of nozzles 16, 18 in accordance with an exemplary but nonlimiting embodiment. In the preferred arrangement, the nozzles are substantially identical but have different orifice sizes. The body 12 is best appreciated from FIGS. 2-4 where the nozzles 16, 18 and multi-nozzle shuttle 14 have been removed for ease of understanding. The body 12 has three significant features/functions: (1) the body is formed with an inlet adapter portion or center hub 20 that enables the sprinkler head to be connected to a drop tube, riser or other irrigation component (e.g., a pressure regulator) via the threaded inlet end 22. The adapter portion or center hub 20 also includes an extended, substantially cylindrical portion 24 extending axially through the body, having a bore forming a first flow passage 26 (see e.g., FIGS. 2, 3 and 9) for supplying water to the nozzle; (2) the body 12 supports the multi-nozzle shuttle 14 via paired pivot bosses 28, 30 and 32, 34 (best seen in FIG. 4) and provides an intermediate nozzle guide platform 36; and (3) the body 12 may be provided with a coupling skirt or peripheral wall 38 by which an otherwise conventional, rotatable (or stationary) water distributor or deflector plate (see FIG. 24) may be connected to the sprinkler head for rotation upon impingement of a stream from the selected nozzle. Additional details with respect to each feature are provided below.

With reference especially to FIGS. 1-4, the inlet adapter portion or center hub 20 and intermediate nozzle guide platform 36 are vertically-spaced and connected by means of diametrically-opposed standards or struts 40 and 42 connected by a top wall 44 that, in turn, is joined to the center hub 20 at the interface of the threaded inlet end 22 and the extended cylindrical portion 24. This arrangement provides the space needed to accommodate the extended cylindrical portion 24 and the multi-nozzle shuttle 14 as explained further below. It will be appreciated, however, that other standard or strut arrangements, including using, for example, three standards or struts, are within the scope of the invention. The lower end of the flow passage or bore 26 of the extended cylindrical portion 24 is provided with an annular seal ring 23 that receives a seal 25 (FIGS. 9, 11, 13 and 15) that is adapted to seal against an upper surface of the shuttle 14 as will be described in greater detail below. The seal 25 may be constructed from EPDM rubber or other suitable material. The standards or struts 40 and 42 are mirror images of each other, and include respective center sections 46, 48 and a pair of oppositely-directed, open frames or wings 50, 52 and 54, 56.

Figure 4:
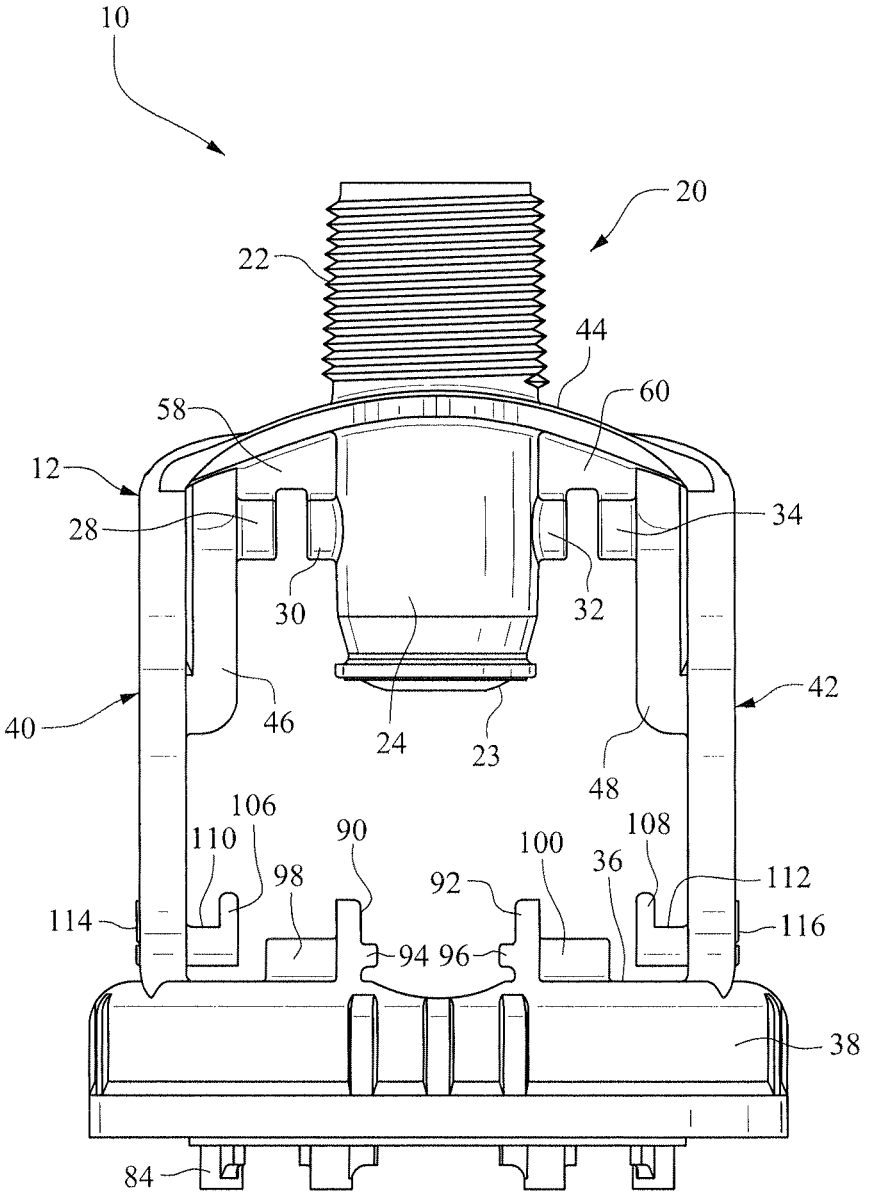
FIG. 4 is a front elevation of the sprinkler body shown in FIGS. 2 and 3.
Figure 14:
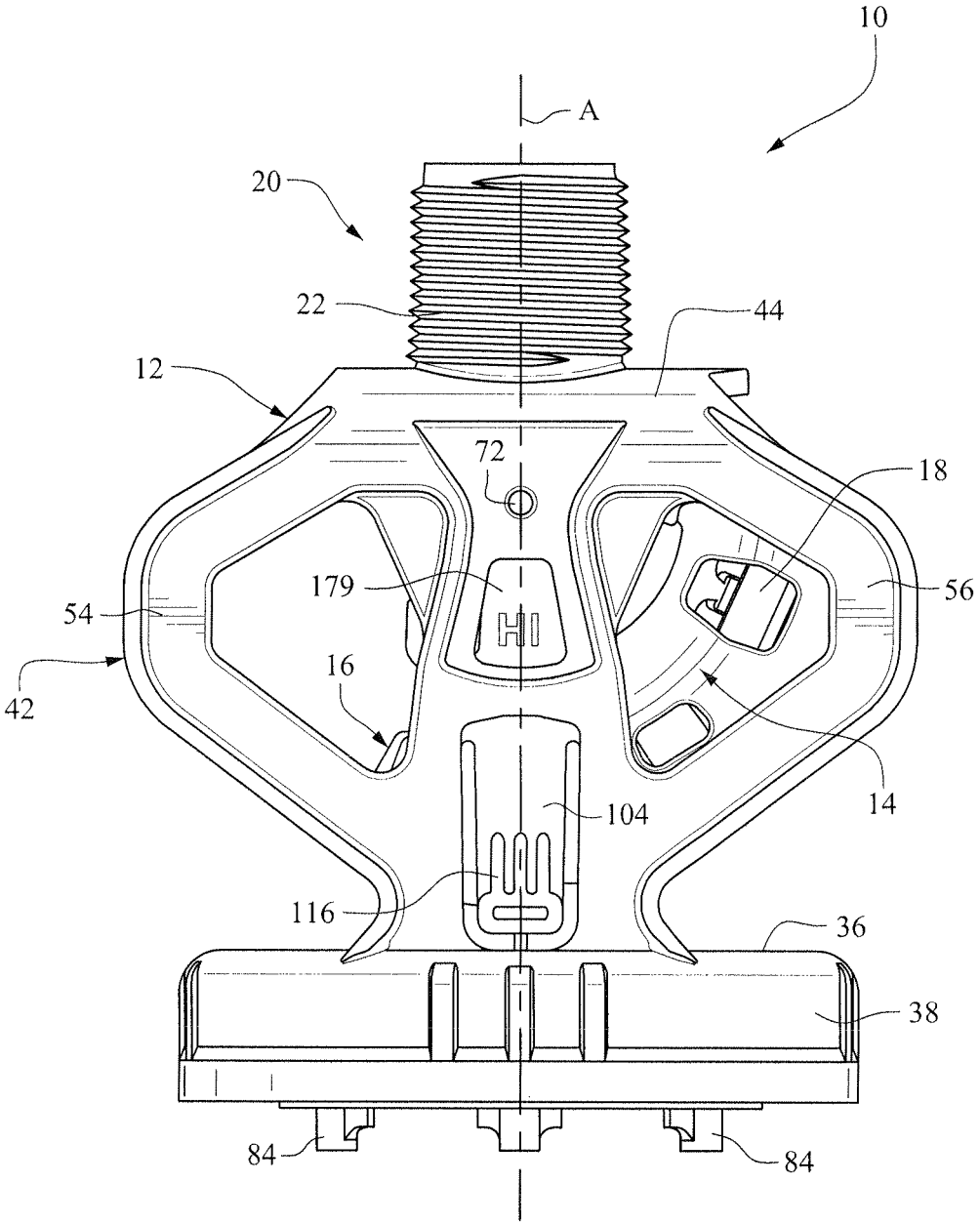
FIG. 14 is a side elevation of the sprinkler head with a high-flow rate nozzle in the operative or nozzle-installed position, also as shown in FIG. 1.
Figure 15:
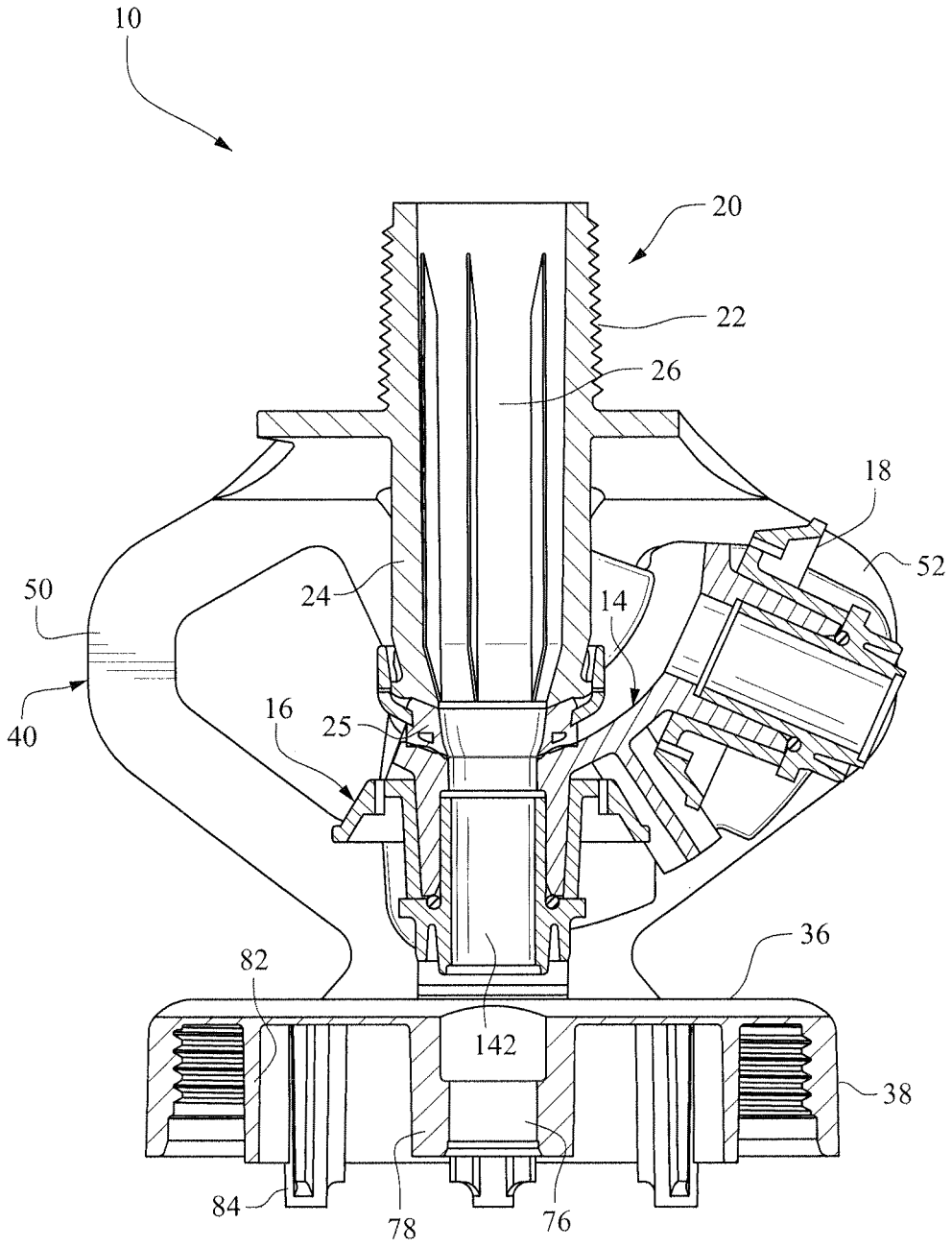
FIG. 15 is a cross section taken through the center of the sprinkler head shown in FIG. 14.

As best seen in FIG. 4, the one set of paired pivot bosses 28, 30 are formed between the center section 46 of the standard 40, the extended cylindrical portion 24 and a reinforcing gusset 58 extending downwardly from the top wall 44. A similar arrangement is found on the opposite side of the sprinkler body with respect to paired pivot bosses 32, 34, standard 42, top wall 44 and gusset 60. Pivot ears or tabs 62 and 64 of the shuttle (described further below in connection with FIGS. 5 and 6), formed with pivot bosses 66, 68 respectively, are located in the gaps between the paired pivot bosses 28, 30 and 32, 34. Pivot pins 70, 72 extend horizontally through the respective center sections of the standards, through the pivot ears and paired bosses. (See FIGS. 1, 11 and 14.) This arrangement allows the multi-nozzle shuttle 14 to be suspended from the respective pivot pins 70, 72 for swinging movement about a horizontal axis as defined by the pivot pins 70, 72 that is substantially perpendicular to the longitudinal or vertical center axis "A" passing through the center hub 20, extended cylindrical portion 24 and bore 26.

The nozzle guide platform 36 and integral coupling skirt 38 are joined to the lower ends of the standards 40, 42. The vertical center axis "A" (shown only in FIGS. 3, 8 and 14) also passes through whichever one of the nozzles 16, 18 is located in the operative or installed position, as well as a center opening 76 (FIGS. 9 and 11) in the hub 78 of the guide platform 36. (See FIG. 3.) The axis A thus defines an axial flow path/direction for a stream supplied to the inlet adapter portion or center hub 20.

Figure 3:
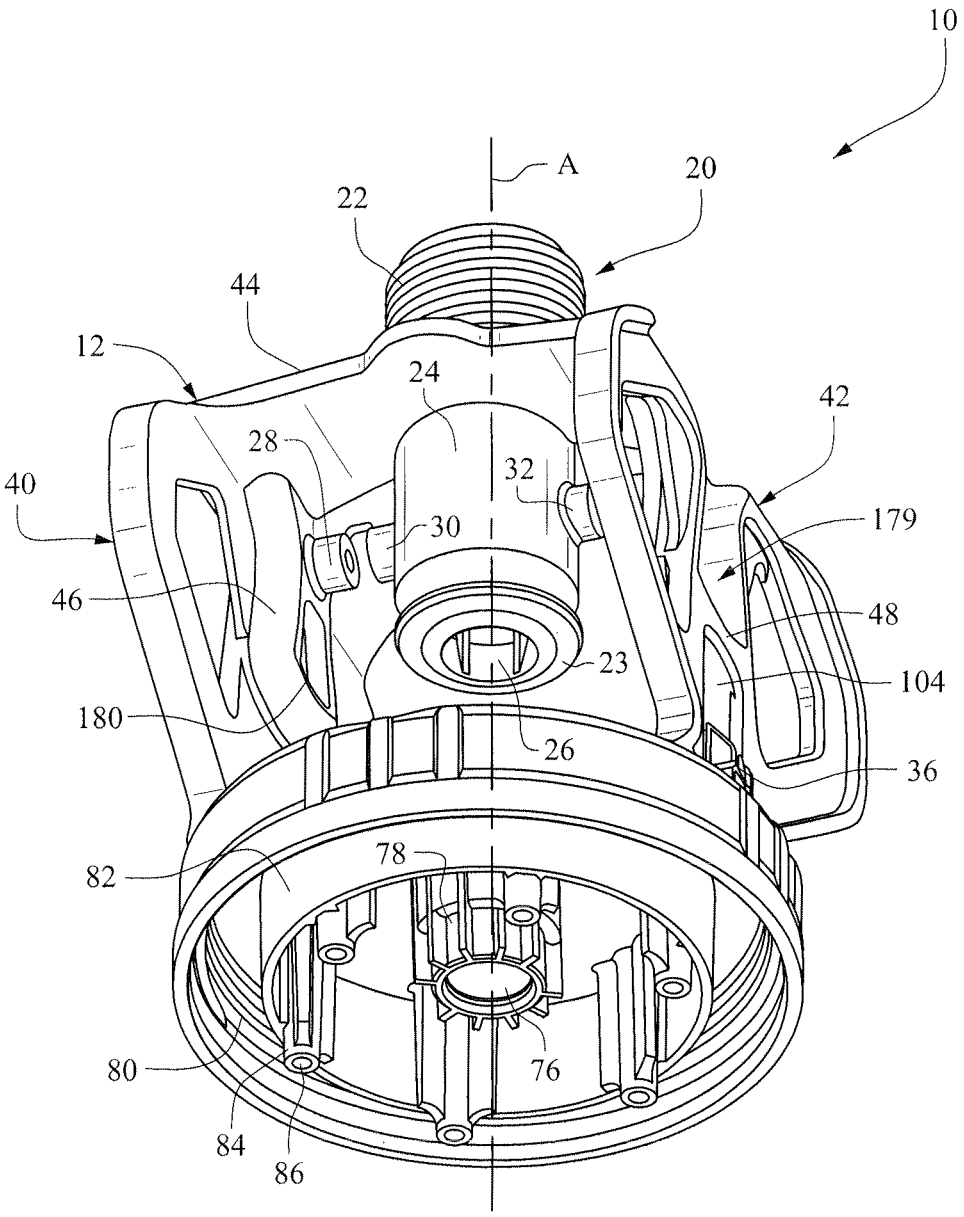
FIG. 3 is a bottom, front, right perspective view of the sprinkler body shown in FIG. 2.

An interior surface of the peripheral skirt 38 may be threaded as shown at 80 in FIG. 3 to facilitate attachment of an optional weight. Other features within the confines of the skirt 38 include the inner annular wall 82, spoked hub 78, and various ribbed structures such as 84 (which may be formed with threaded or unthreaded bores 86) which may be used to reinforce the platform 36 and skirt 38 and/or to facilitate attachment of a water deflector plate housing or the like. In most applications, the center of the deflector plate will lie on the axis A, and the deflector plate may be stationary or rotatable about the axis. The specific manner of attachment of the deflector plate forms no part of the invention, and may include threaded connection as mentioned above, a press-and-turn mechanism, a bayonet fitting, screws or any other suitable attachment arrangement. An exemplary water deflection plate and optional weight are described further herein in connection with FIGS. 24 and 25.

Figure 2:
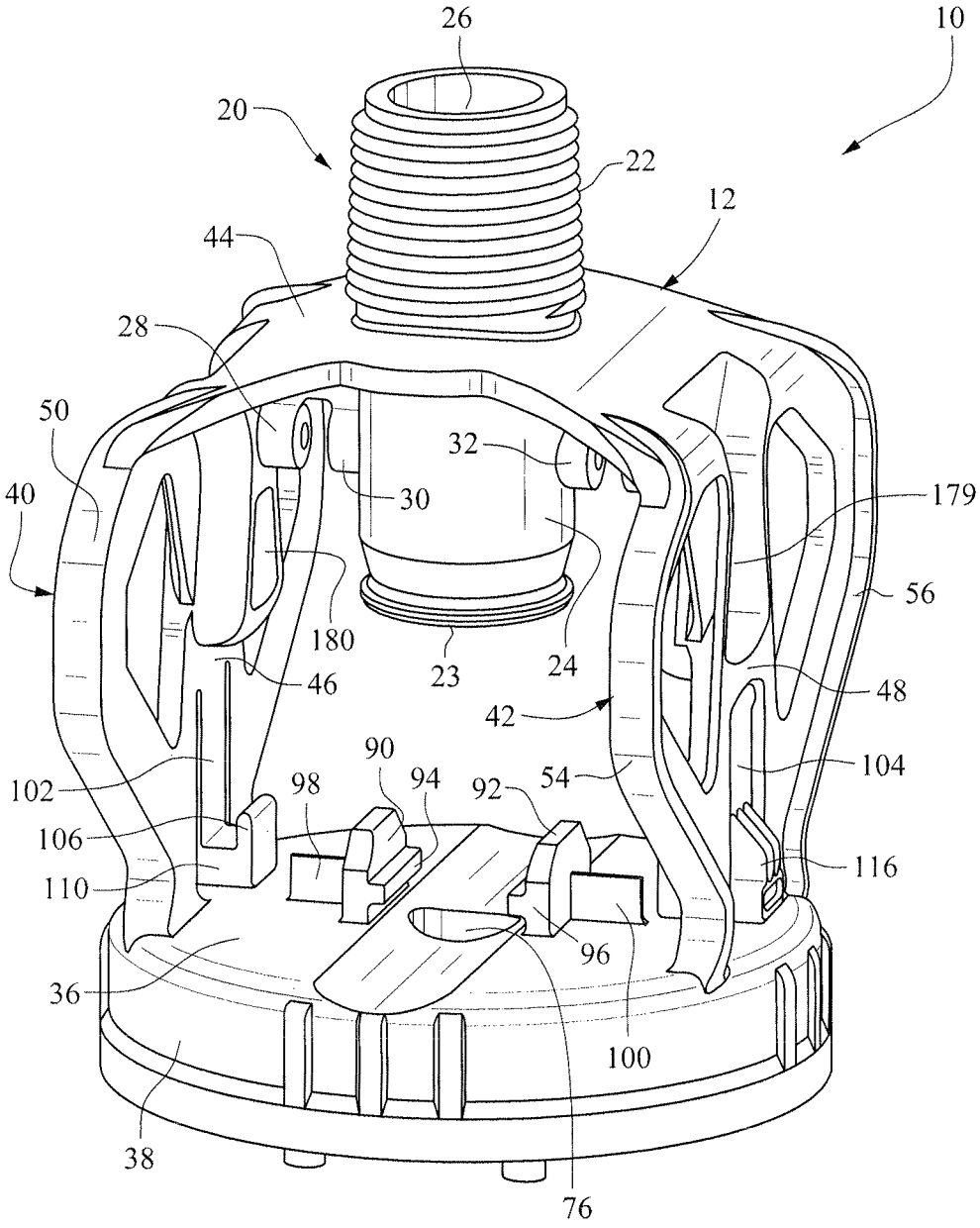
FIG. 2 is a top, front, right perspective view of the sprinkler body.

With reference specifically to FIGS. 2 and 4, the nozzle guide platform 36 is formed with a pair of laterally-spaced upstanding ribs 90, 92, provided with inwardly-directed respective nozzle-support shoulders 94, 96. Outwardly extending ribs 98, 100 reinforce the ribs 90, 92 but also provide limit stops for a pair of squeeze arms 102, 104 formed in the center sections 46, 48 of the standards 40, 42. The squeeze arms 102, 104 are each provided with a releasable retention tab 106, 108, respectively, which are shaped and sized to fit into any one of the three notch pairs 168, 174; 166, 172; or 164, 170 in the shuttle 14 (FIGS. 5 and 6) depending on the position of the shuttle. Note that the tabs 106 and 108 are offset via horizontal portions 110, 112 such that in a normal, unstressed position, the tabs will substantially precisely locate in one of the aforementioned notch pairs upon swinging movement of the shuttle, with the horizontal surface 110, 112 at a height that permits the lower edges of the shuttle 176, 178 (see FIG. 6) to slide along the surface portions 110, 112 (see FIG. 4) when the squeeze arms 102, 104 are pressed inwardly.

The outside surfaces of the squeeze arms 102, 104 are provided with respective enlarged gripper portions 114, 116 to facilitate the inward squeezing of the arms as described further herein.

Figure 5:
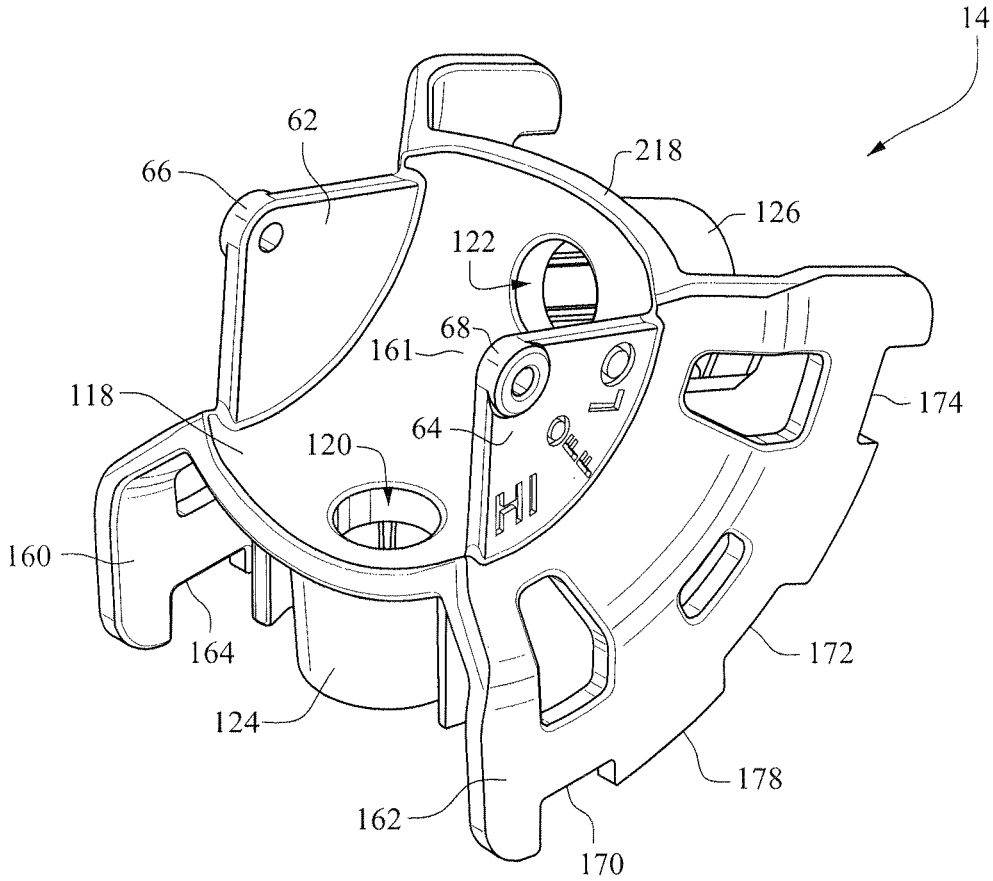
FIG. 5 is a top, front, right perspective view of the multi-nozzle shuttle removed from the sprinkler head, and with the nozzles removed from the shuttle.
Figure 6:
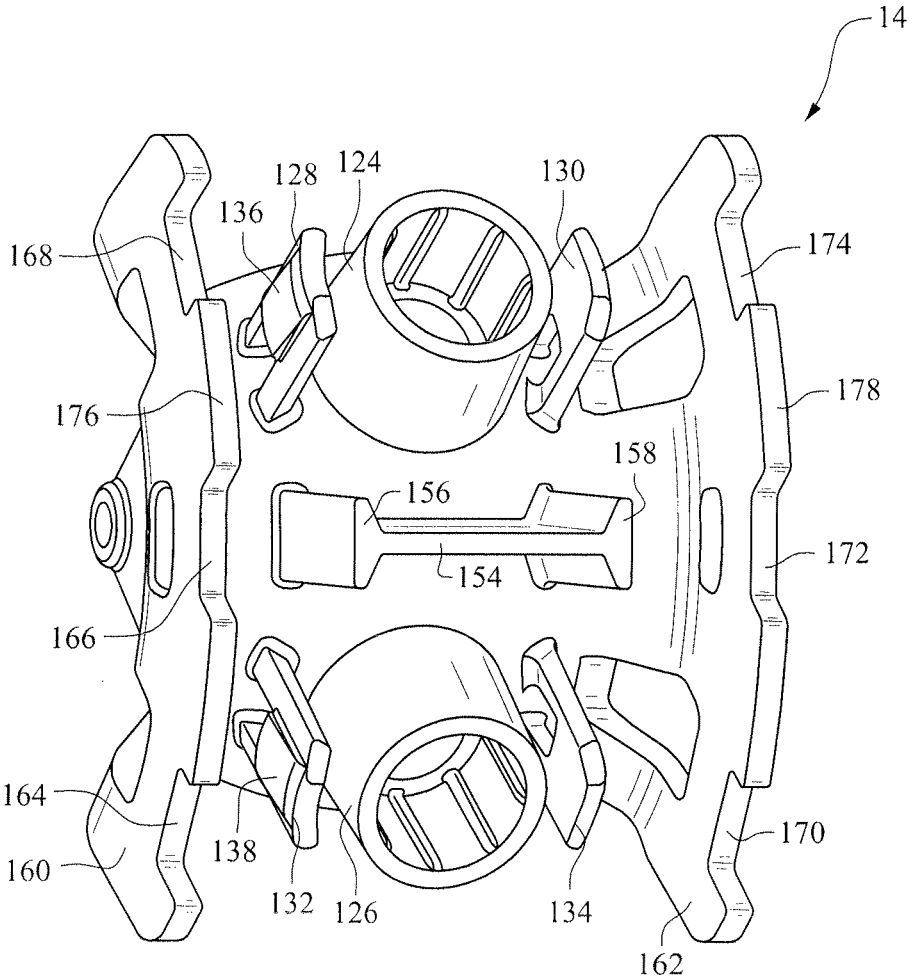
FIG. 6 is a bottom, rear left perspective view of the multi-nozzle shuttle shown in FIG. 5.

With reference now to FIGS. 5 and 6, the multi-nozzle shuttle 14 is formed to include the pair of upstanding pivot ears 62, 64, that receive the pivot pins 70, 72, respectively, as described above. The pivot ears 62, 64 extend from a nozzle support platform 118 having a generally upwardly-concave shape, and formed with openings 120 and 122 that continue through respective cylindrical support hubs 124, 126 projecting from the underside of the nozzle support platform. The support hubs 124, 126 are each flanked by a pair of resilient spring tabs 128, 130 and 132, 134, respectively, formed integrally with the support platform 118, and radially spaced from their respective hubs. The support hubs 124, 126 and respective resilient tabs 128, 130 and 132, 134 combine to provide a pair of nozzle holders for the two nozzles 16, 18 carried by the shuttle 14. Note that the tabs are each provided with an integral projecting pad on their outer sides (two shown in FIG. 6 at 136, 138), respectively, that enable a nozzle to be locked in place on the multi-nozzle shuttle.

Figure 7:
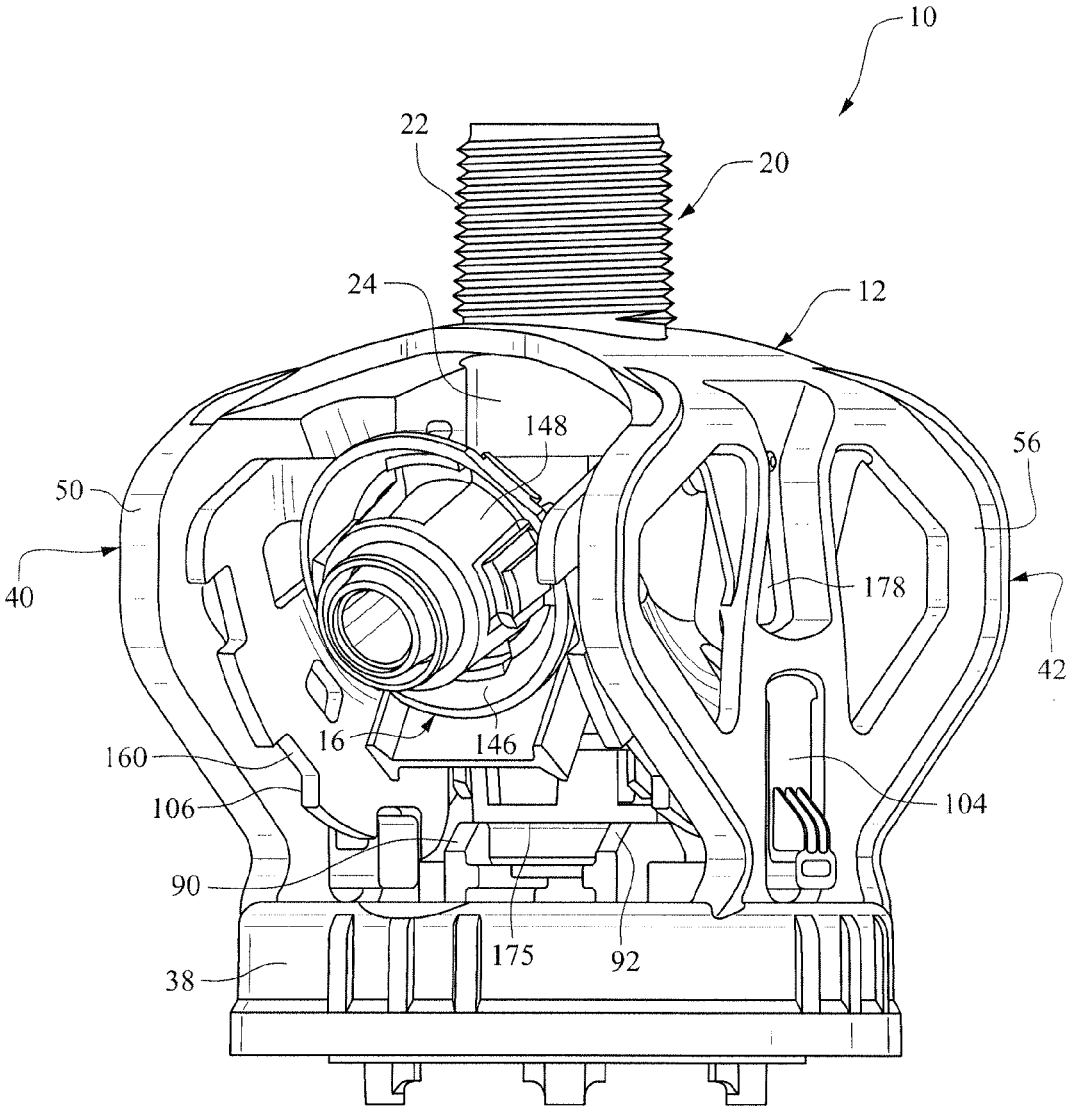
FIG. 7 is a front, right perspective view of the sprinkler head shown in FIG. 1, but with the other of the two nozzles shown in the operative or nozzle-installed position.
Figure 9:
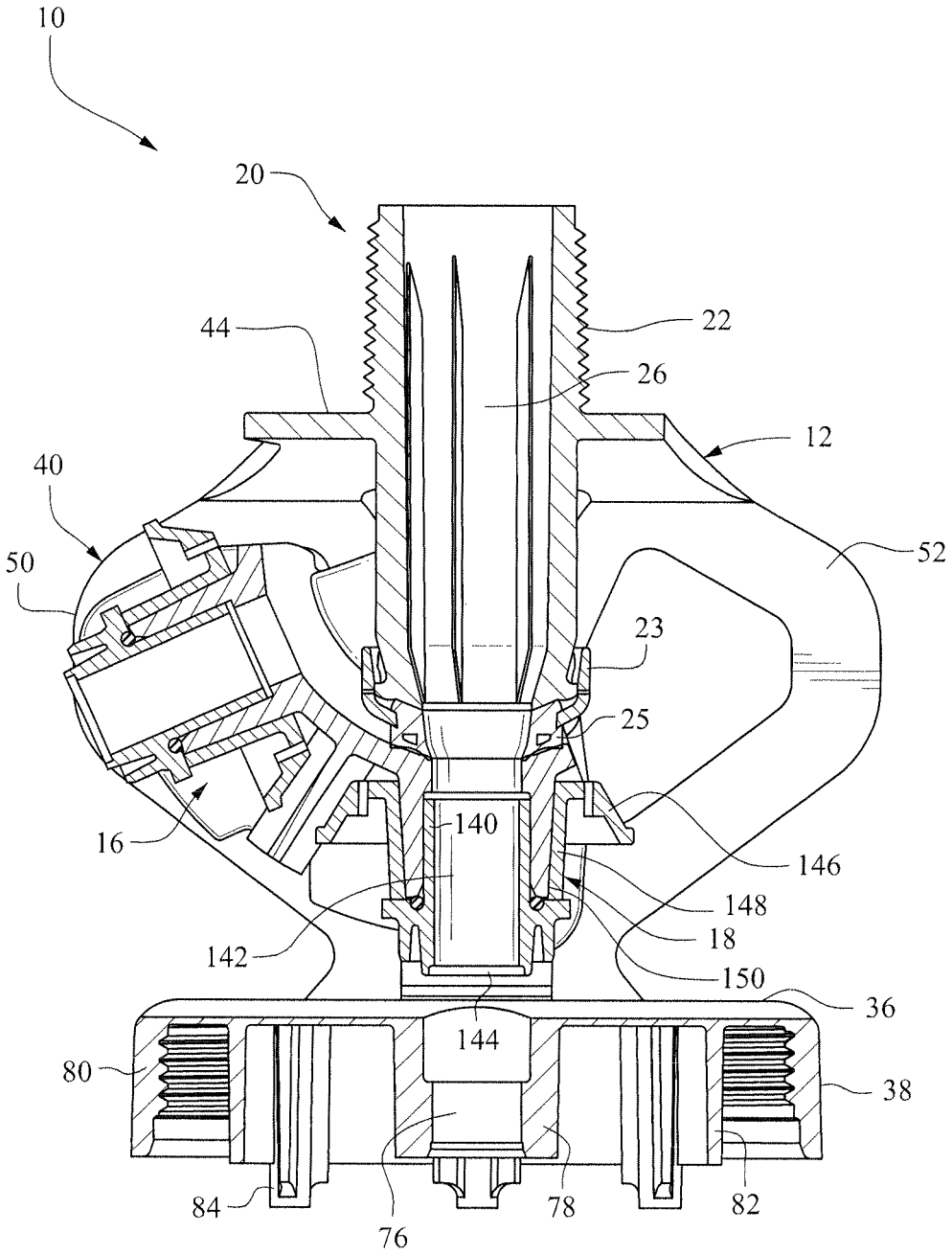
FIG. 9 is a cross section taken through the center of the sprinkler head shown in FIG. 8.
Figure 10:
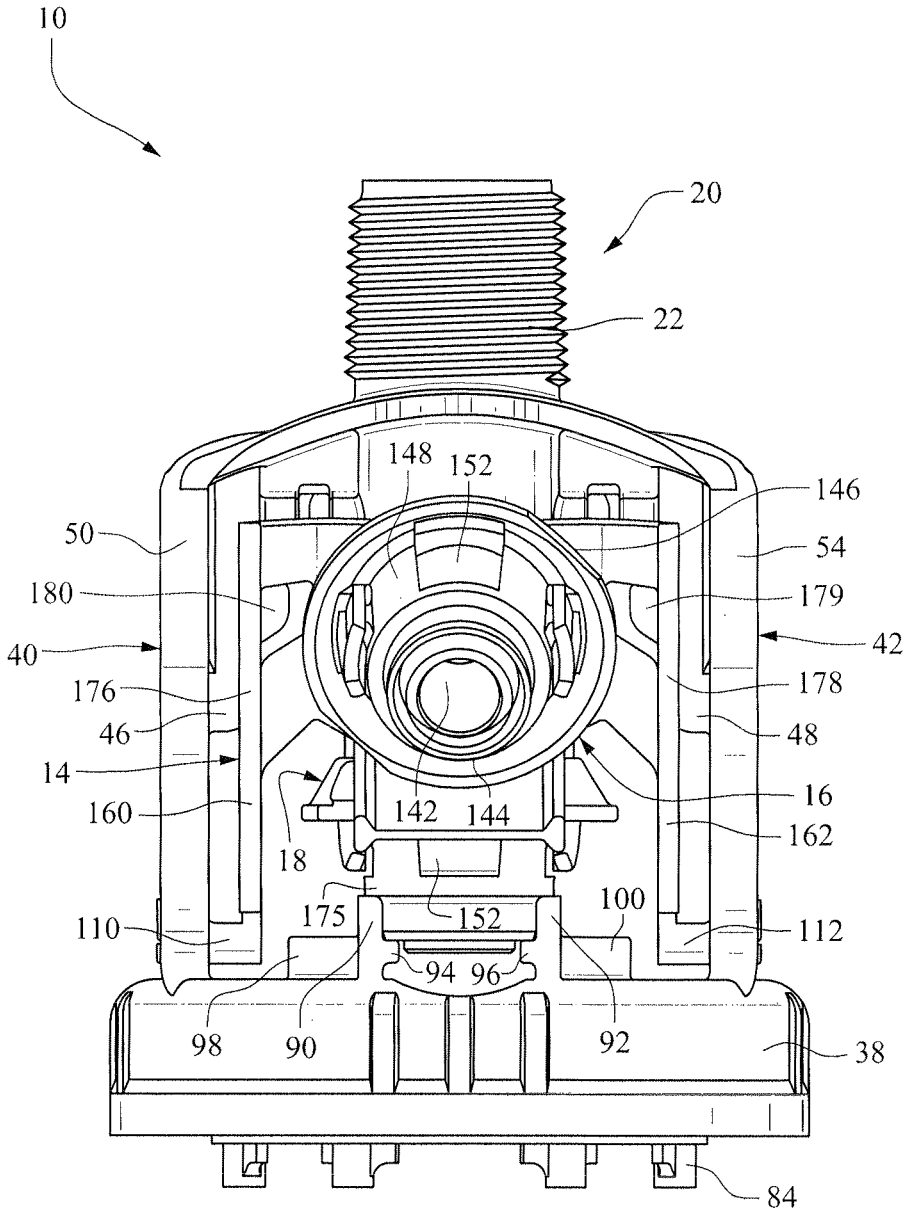
FIG. 10 is an end view of the sprinkler head shown in FIG. 8.
Figure 11:
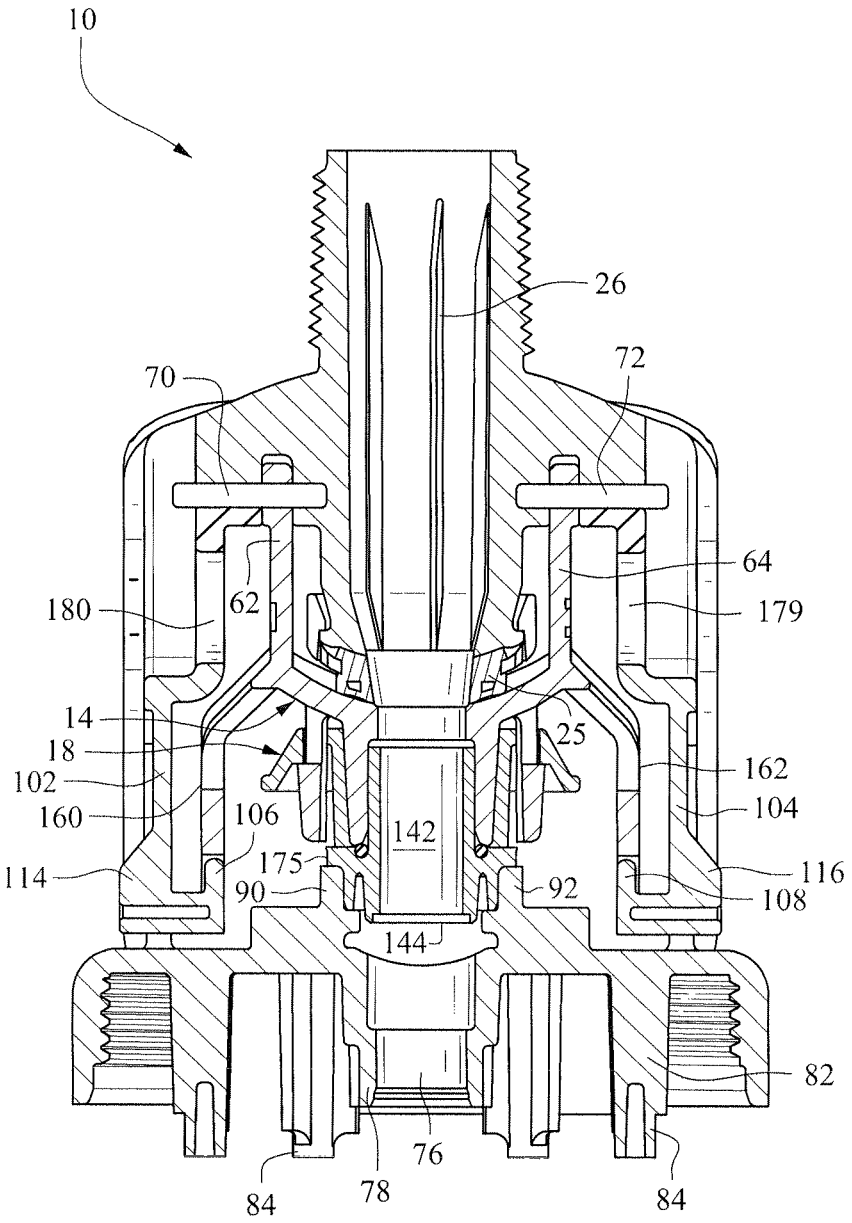
FIG. 11 is a cross section taken through the center of the sprinkler head shown in FIG. 10.

More specifically, and as best seen in FIGS. 7, 9 and 10, the nozzle 18 is formed with a center hub 140 defining a nozzle bore 142 and a nozzle orifice 144. An outer peripheral ring 146 (which may be used for nozzle size identification purposes) is supported by means of webs or spokes 148 that establish an annular gap 150 between the spokes and the nozzle center hub 140. Openings or windows 152 are circumferentially located between the webs or spokes 148. (See FIGS. 1 and 10.) Thus, the nozzle center hub 140 may be inserted into a respective support hub 124 or 126 on the underside of the shuttle 14, with the ring 146 and spokes 148 located radially outwardly of the support hub. This enables the projecting pads (e.g., 136, 138) to be received in a pair of diametrically-opposed windows 152 between the spokes 148. Nozzles of this type are described in greater detail in commonly-owned U.S. Pat. No. 5,415,348.

It will thus be appreciated that both nozzles may be firmly held in place on the nozzle holders provided on the underside of the multi-nozzle shuttle 14, but can be removed easily by pivoting the shuttle in either of two opposite directions to locate one of the nozzles in an offset or inoperative position (see FIG. 7), and then squeezing the spring tabs 128, 130 or 132, 134 inwardly and sliding the nozzle off its support hub. It will be understood that while two resilient tabs are shown for each nozzle, it is contemplated that one or more than two such tabs could also be used to secure the nozzle on the shuttle 14. It will also be appreciated that the multi-nozzle shuttle 14 could be extended to accommodate one or more additional nozzles.

As best seen in FIG. 6, a radially-extending, transversely-oriented rib 154 is located circumferentially between the adjacent nozzle holder hubs 124, 126. The rib 154 is formed with circumferentially-expanded ends 156, 158 that align with the upper edges of the ribs 90, 92 when the shuttle is in a shut-off position as described further herein.

The upper surface of the nozzle support platform 118 is shaped to provide a concave shut-off surface or surface portion 161 (see FIG. 5) between the bores 120, 122. Note that the support platform is concave in two directions. An outer pair of shuttle locking or positioning arms 160, 162 extends outwardly and downwardly from the support platform 118. Each arm 160, 162 is formed with three notches (164, 166, 168 on arm 160 and notches 170, 172 and 174 on arm 162). The notches are formed along arcuate edges 176, 178 of the respective arms, and may be engaged by the resilient retention tabs 106, 108 provided within the diametrically-opposed standards 40, 42. When so engaged, the shuttle 14 is releasably retained in any of the three selected positions defined by opposed pairs of notches. It will be appreciated that other retention mechanisms, including substantially rigid snap-in configurations are contemplated.

In either of the two nozzle-installed or operative positions of the shuttle 14, the bore or flow passage 26, openings 120 or 122, and nozzle bores 142 defining second flow passages (of nozzle 16 or 18), are aligned along the axis "A" and the shut-off surface portion 161 is offset to one side, as will be explained below.

Figure 8:
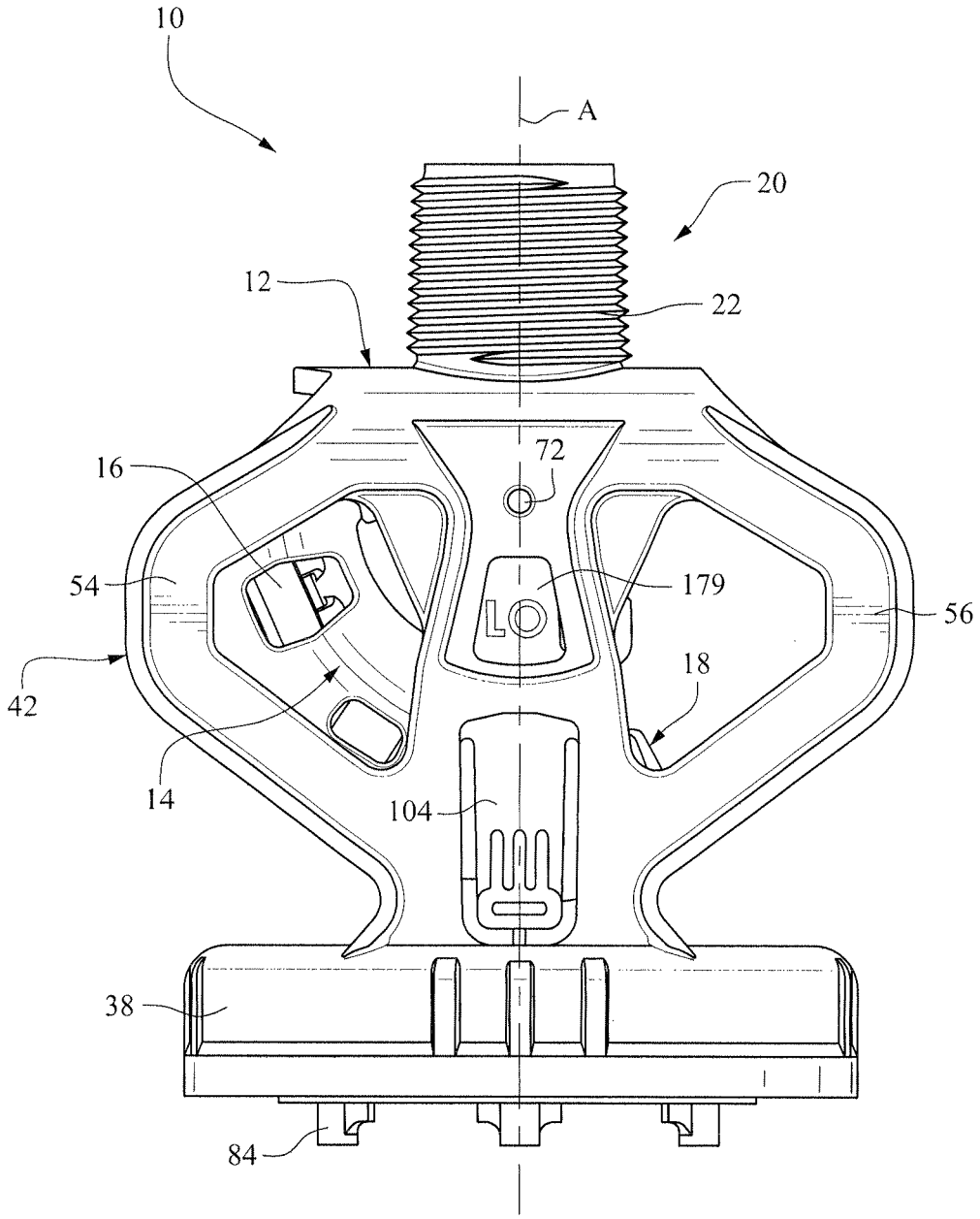
FIG. 8 is a side elevation of the sprinkler head shown in FIG. 7.

Turning now to FIGS. 7 and 8, a low-flow rate nozzle 18 is shown in a nozzle-installed position with the retention tabs 106, 108 engaged within notches 168 and 174 of the shuttle 14. In this position, the nozzle bore or second flow passage 142 is aligned with the outlet and end of the bore or first flow passage 26 and center opening 76. The rim 175 of the nozzle is engaged with the ribs 90, 92, and the shut-off surface portion 161 is laterally offset from the flow passage 26. At the same time, the seal 25 engages about the periphery of the opening 122 to preclude leakage at the nozzle. It is also noted that in this position, nozzle 16 (a high-flow rate nozzle) is located in a laterally-offset or withdrawn position from which that nozzle can be easily removed and/or replaced.

When it is desired to switch to nozzle 16, the user will squeeze the arms 102, 104 to move the retention tabs 106, 108 out of the notches 168, 174 to thereby release the shuttle 14 for swinging movement away from the first nozzle-installed position. Note that the squeezing motion is limited by the ribs 98, 100, thus providing the correct alignment of the positioning arms 160, 162 (and edges 176, 178) with the space provided by the horizontal portions 110, 112 of the retention tabs 106, 108, thereby permitting the subsequent swinging movement of the shuttle. The user will then pivot the shuttle 14 about the pivot pins 70, 72 across the nozzle shut-off position described further below and further along the arcuate path of the shuttle until nozzle 16 is in the second nozzle-installed position.

If it is also desired to replace a nozzle with one of a different size, the nozzle at issue may be removed from the shuttle as described above, with easy access to the nozzle afforded when the shuttle 14 is rotated to one of the two nozzle-installed positions, leaving the other, inoperative nozzle exposed for easy removal/replacement. With a new nozzle installed on the nozzle holder, the shuttle may be left in its current position or pivoted back to either one of the two remaining positions.

Figure 12:
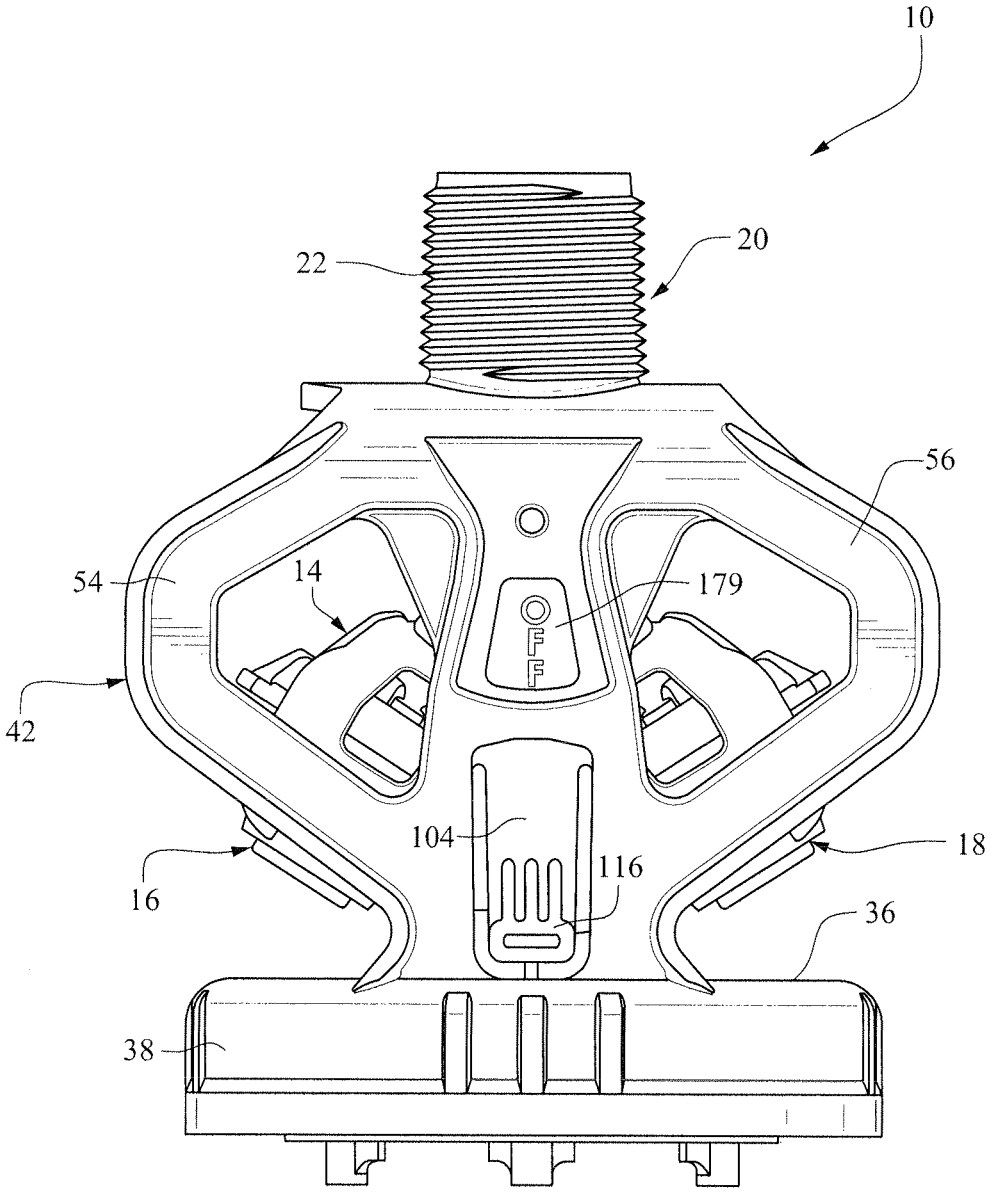
FIG. 12 is a side elevation of the sprinkler head with the multi-nozzle shuttle in a shut-off position.
Figure 13:
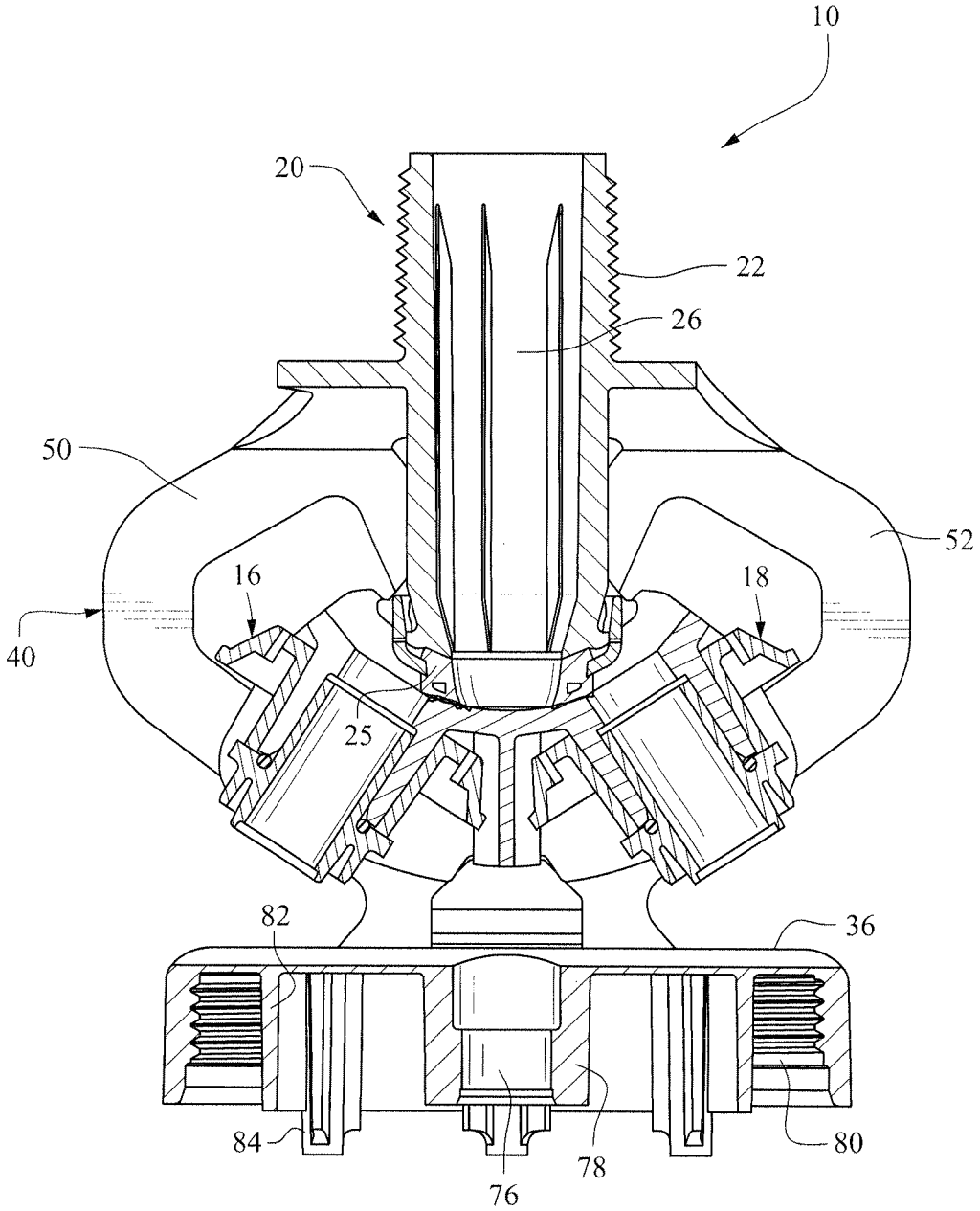
FIG. 13 is a cross section taken through the center of the sprinkler head shown in FIG. 12.

If it is desired to simply shut off the sprinkler, the shuttle 14 is pivoted to the shut-off position, where the shut-off surface portion 161 is engaged by the seal 25 as shown in FIGS. 12 and 13. The enlarged ends 156, 158 of the rib 154 engage the upper edges of ribs 90, 92 on the nozzle support platform, thus providing stable support to the shuttle. In this "center" or shut-off position, the retention tabs 106, 108 are engaged within the shuttle notches 166, 172.

Suitable indicia may be provided on the shuttle pivot ears 62, 64 indicating the various positions of the shuttle. For example, if the nozzles 16, 18 are low- and high-flow rate nozzles, indicators such as "LO" and "HI" (or any other suitable indicia) may be applied to opposite ends of one or both pivot ears, with an "OFF" indicator located in between. (See, for example, FIGS. 1, 5, 8, 12 and 14). All indicators are visible through one or both windows 179, 180 in the center sections of the standards 40, 42. (See FIGS. 8, 12 and 14.)

In another exemplary but nonlimiting embodiment illustrated in FIGS. 16-20, a power actuator 182 is connected between the multi-nozzle shuttle 184 and a connector or coupling 186, attached to the sprinkler body center hub 20, by which the sprinkler head is connected to the water supply hose or conduit. In the example shown, the power actuator comprises a pneumatic cylinder 188 and associated piston 190. One end of the cylinder 188 is pivotally attached to a bracket assembly 192, and a clevis 194 attached to the free end of the piston 190 is pivotally secured to a boss 196 extending outwardly of the multi-nozzle shuttle 184 by means of a pin 198 held to the clevis by one or more retention washers 200. The connection could also be made with a spring, an over-center-type linkage, a flexible membrane or other suitable mechanism as will be appreciated by those skilled in the art. It will also be appreciated that the cylinder 188 is connected to a manually-operated or automatic control device that extends and retracts the piston 190 in accordance with a predetermined sprinkling pattern or other protocol.

Figure 16:
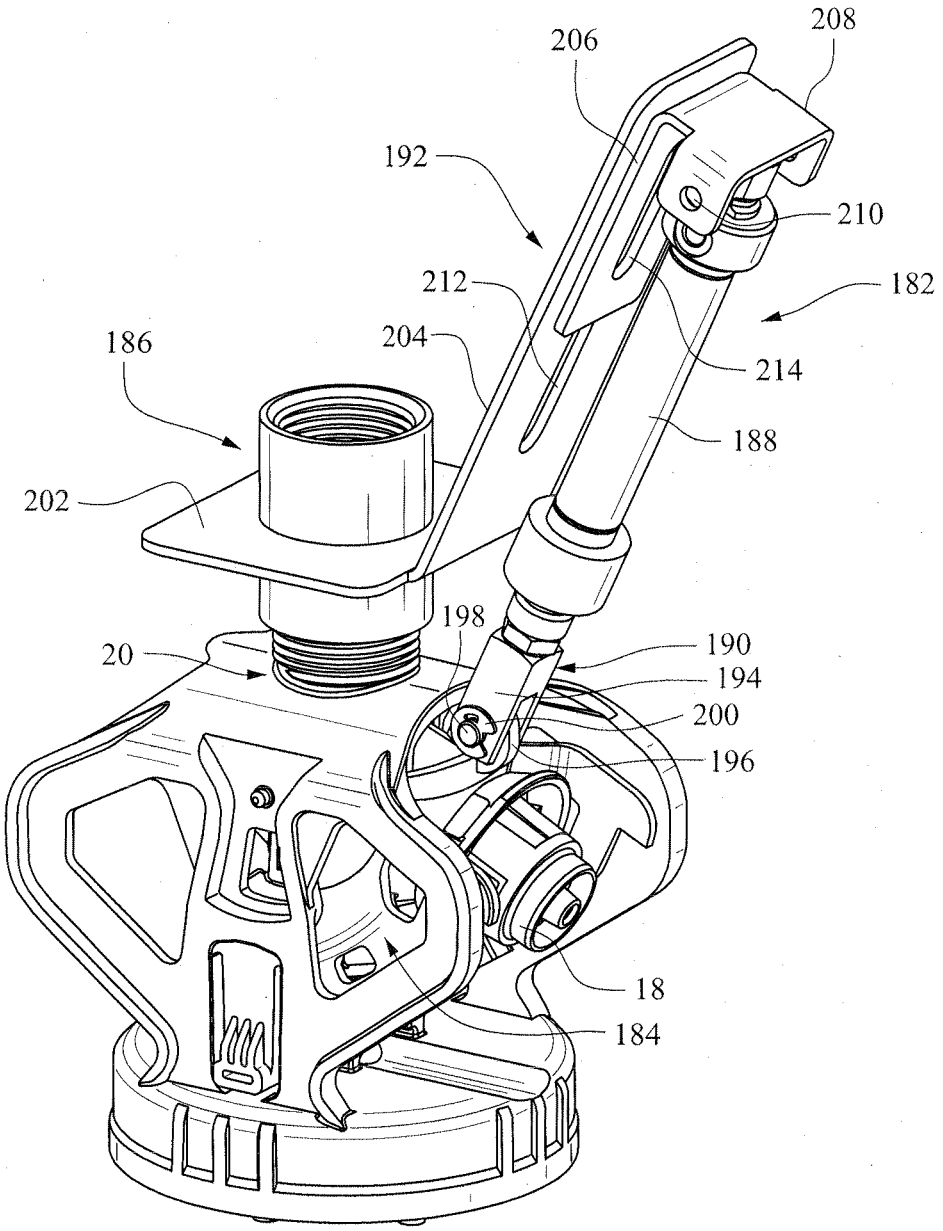
FIG. 16 is a perspective view of a sprinkler head substantially as shown in FIGS. 1-14, but incorporating a power actuator in a first position in accordance with a second exemplary but nonlimiting embodiment of the invention.

In the example shown in FIGS. 16-20, the bracket assembly 192 includes a first end 202 welded or otherwise suitably secured to (or integral with) the coupling 186. The bracket assembly 192 also includes a first-inclined plate 204 extending outwardly and away from the sprinkler body that is joined to a second similar but shorter plate 206. The latter is fixed to or part of a pivot mount 208 which secures the cylinder 188 to the bracket assembly 192 by means of a pin 210. The first and second plates are each provided with slots 212, 214, respectively, which are alignable as shown in FIG. 16. A fastener (not visible) may extend through the aligned slots to secure the two plate sections together at selected positions along the overlapped slots. This allows the effective length of the bracket assembly to be adjusted as needed to accommodate the length of the actuator and/or the stroke of the piston 190.

Figure 18:
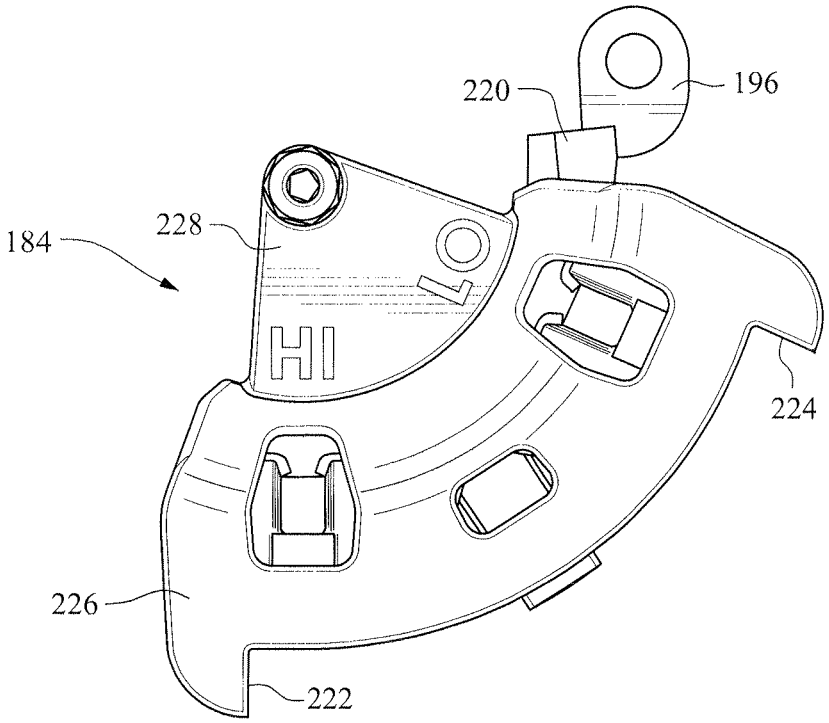
FIG. 18 is a side elevation of a modified nozzle shuttle in accordance with a second nonlimiting embodiment.

Note also that in order to avoid interference with a nozzle loaded on the shuttle 184, the curved end 218 (see FIG. 5) of the platform 118 is extended as shown at 220 in FIG. 18, thus providing an extended support surface for the boss 196.

Figure 17:
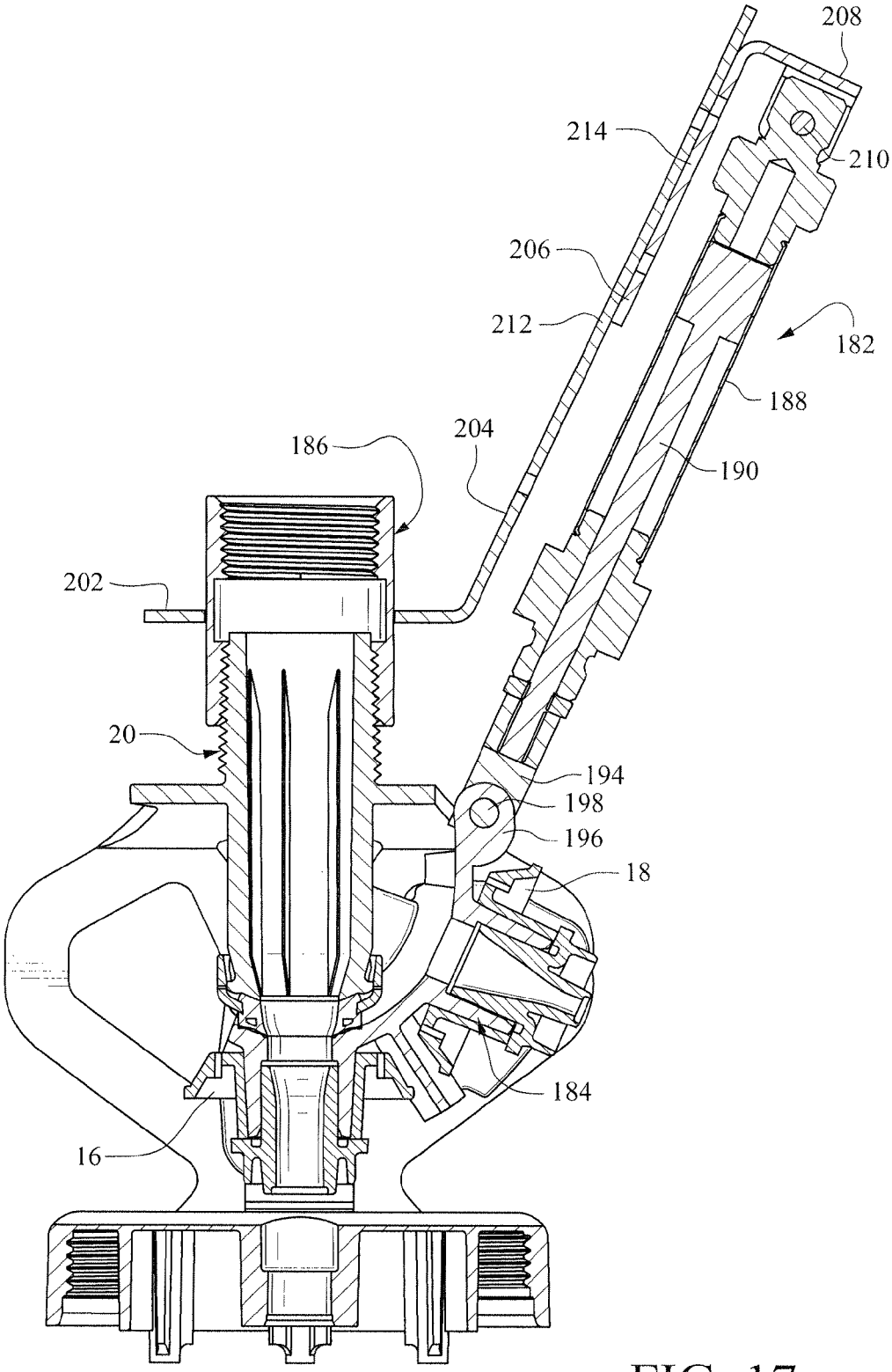
FIG. 17 is a cross section of the sprinkler head as shown in FIG. 16.
Figure 19:
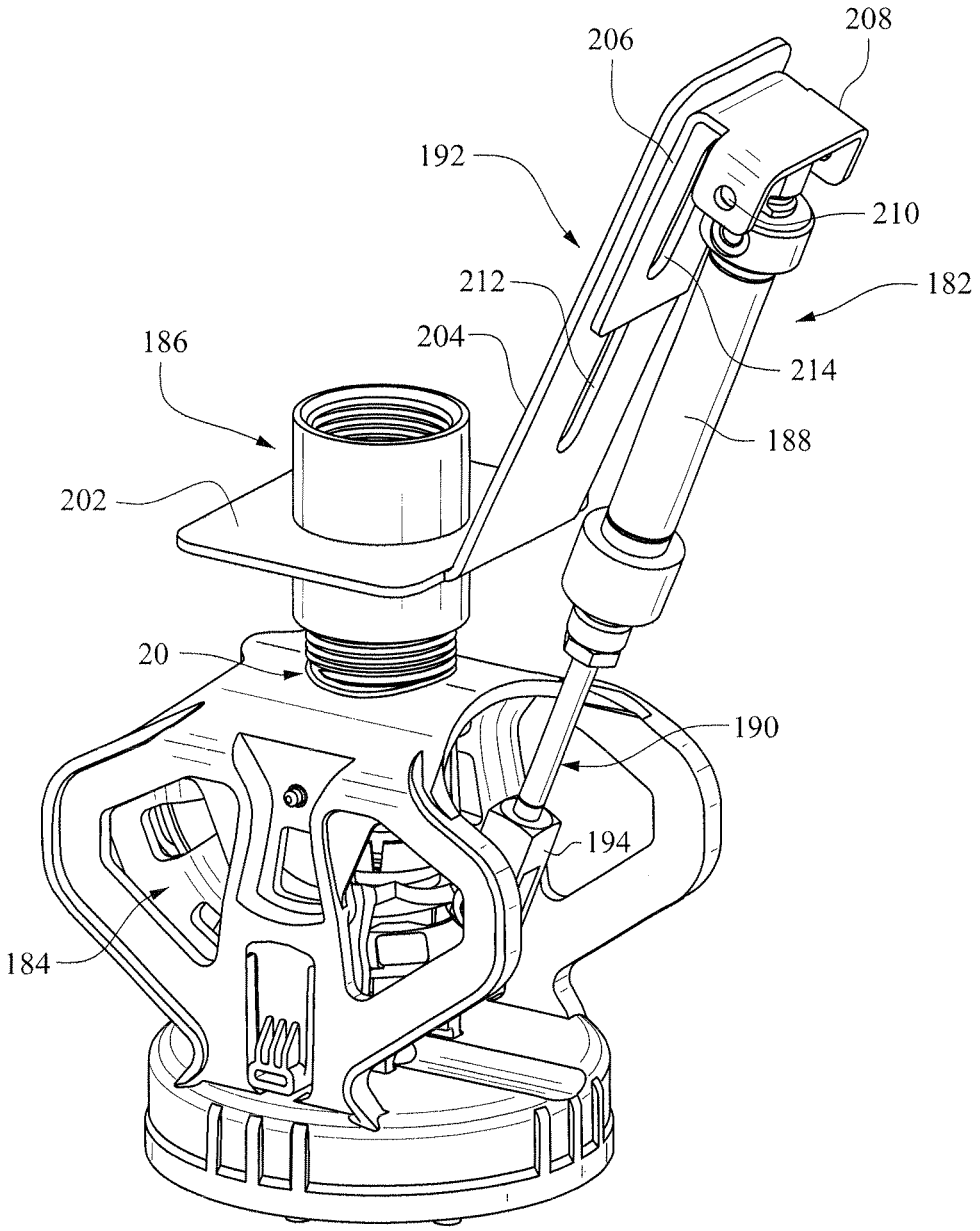
FIG. 19 is a perspective view of the sprinkler head shown in FIG. 16 but with the power actuator in a second position.
Figure 20:
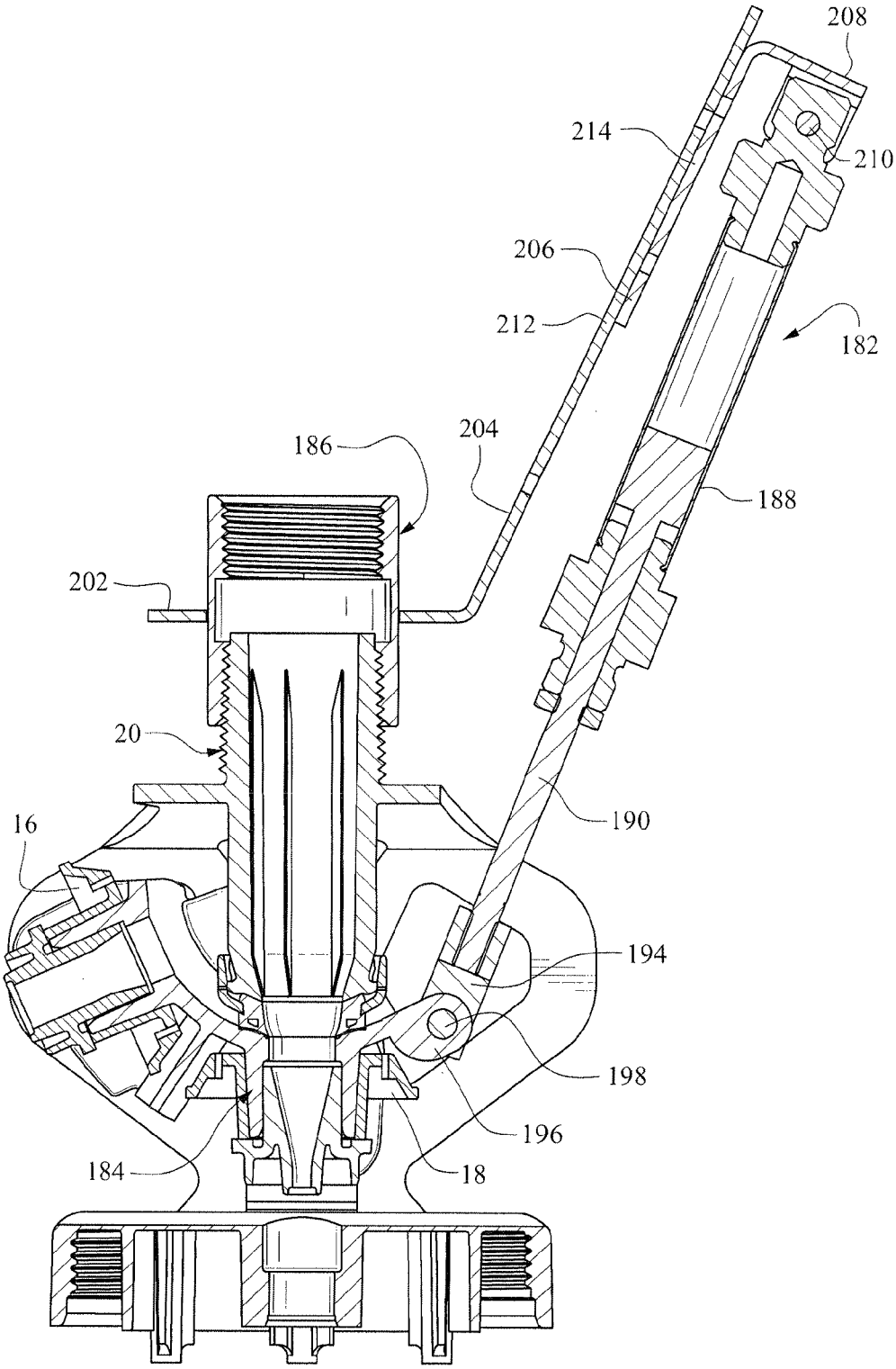
FIG. 20 is a cross section of the sprinkler head as shown in FIG. 19.

When the piston 190 is in the retracted position as shown in FIGS. 16 and 17, the nozzle 16 is in a nozzle-installed position while the nozzle 18 is in a laterally-offset or withdrawn position. With the piston 190 in an extended position as shown in FIGS. 19 and 20, the nozzle 16 is in the withdrawn or laterally-offset position while the nozzle 18 is in the installed position. In this embodiment, the power actuator 182 moves the shuttle 184 between the two nozzle-installed positions, with no "stop" at an intermediate nozzle shut-off position as in the manually-operated embodiment of FIGS. 1-15. It will be understood, however, that a power actuator could be configured/programmed to move the shuttle between more than two positions, for example, a third, shut-off position between the first and second nozzle-installed positions.

Because the movement of the multi-nozzle shuttle 184 describes an arc, it is necessary for the power actuator 182 to be pivotally secured at both ends of the bracket assembly 192. The power actuator 182 may be controlled to move the multi-nozzle shuttle 184 a defined distance corresponding to the desired installed location for each of the two nozzles 16, 18. The installed locations can be defined by, e.g., hard stops formed by the outside edges of the outermost of the three notches on each of the positioning arms 160, 162. In other words, the lower edges of the arms 160, 162 are modified in this embodiment to include two accurately-spaced edges 222 and 224 on arm 226 as shown in FIG. 18. These two edges thus provide limit stops for the extension and retraction movement of the piston 190 and thus define each of the two nozzle-installed positions.

By eliminating the three defined notches in the locking or positioning arms of the first-described shuttle 14, the opposite sides of the retention 106, 108 can serve as the stop surfaces against which the stop edges 222 and 224 abut, without any need to manually squeeze the arms 102, 104 to release the shuttle for further movement. Of course, the arms 102, 104 and tabs 106, 108 could be made stationary in this embodiment.

It will be appreciated that the power actuator 182 may be a pneumatic cylinder as described above, a hydraulic cylinder, solenoid, electric motor or any other suitable device that generates linear or rotary motion. Gas-driven cylinders can use any compressed gas, and the cylinders can be of the double-acting type, or of the single-acting type combined with a return spring. With respect to solenoid actuators, either linear or rotary solenoids (AC or DC) may be used to move the multi-nozzle shuttle between its three positions. Electric motors such as brush motors can directly move the multi-nozzle shuttle through a set of reduction gears, and the motors can drive the multi-nozzle shuttle 184 to hard stops or be limited by time, or in the case of stepper motors, to precise points. Stepper motors also provide the ability to add multiple stop locations if a nozzle shuttle with, for example, three nozzles is employed (or if a shut-off location is included), making it a three-way actuator.

Figure 21:
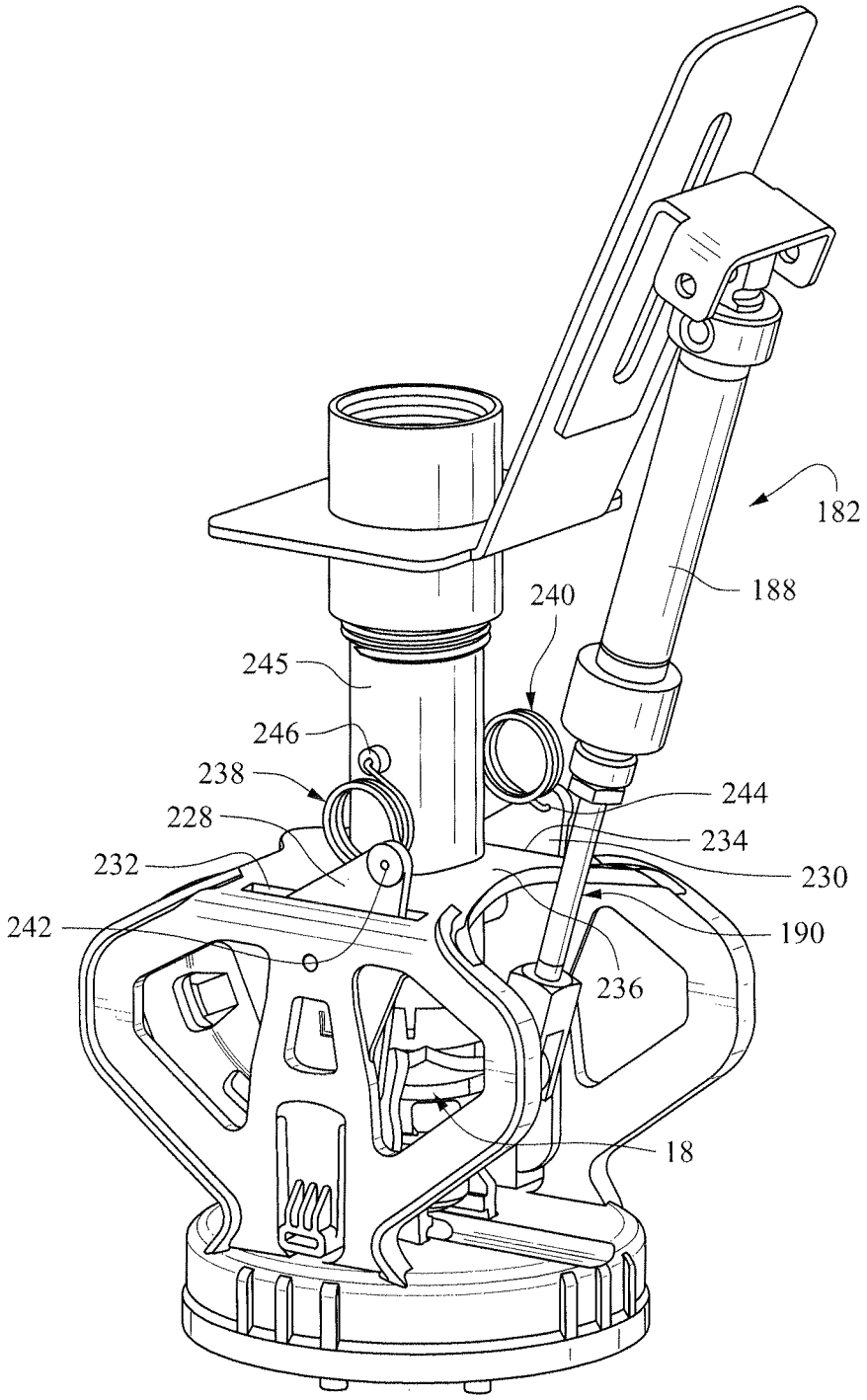
FIG. 21 is a perspective view of a third exemplary but nonlimiting embodiment incorporating a spring retention mechanism, and showing the multi-nozzle shuttle and power actuator in a first position.
Figure 22:
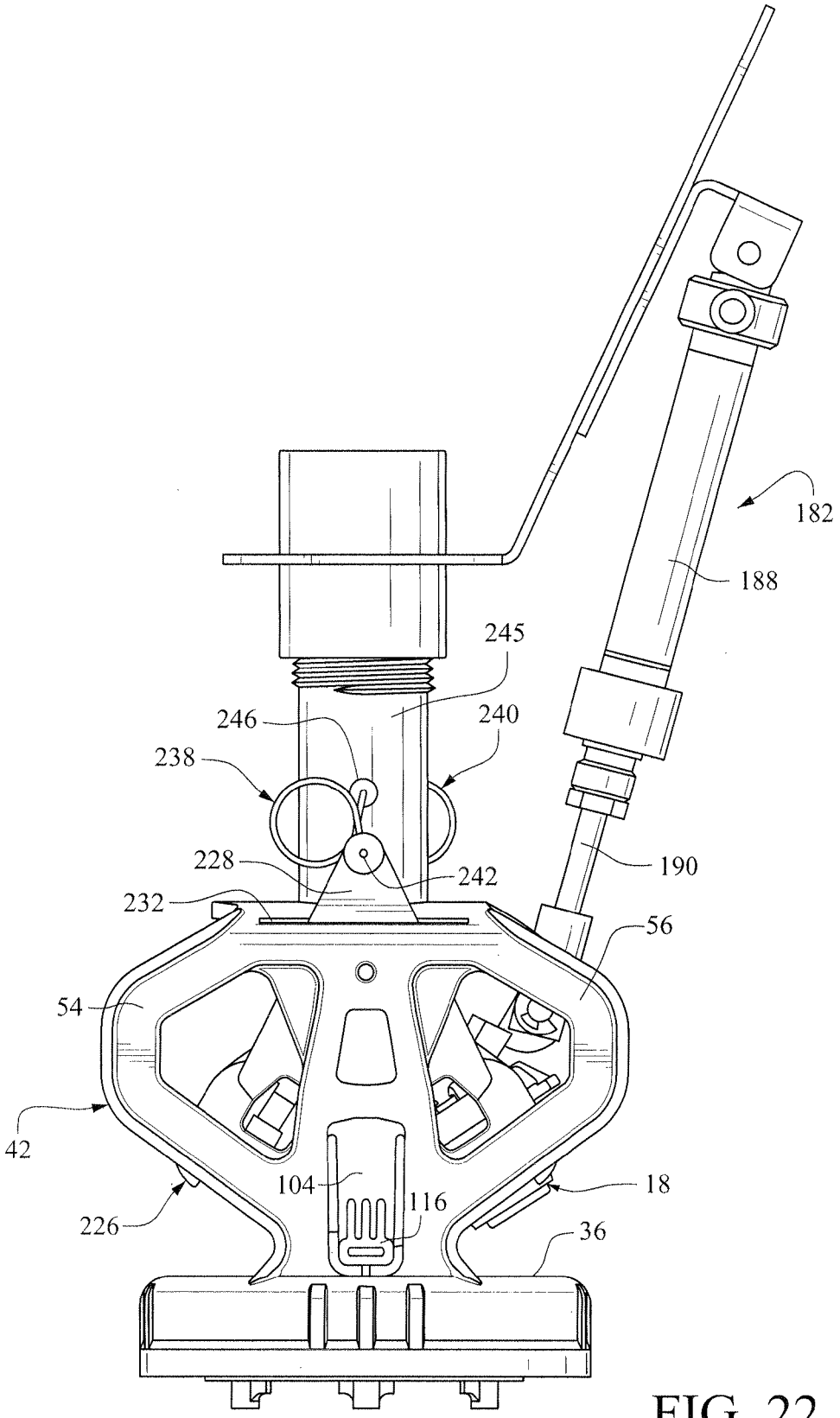
FIG. 22 is a side elevation of the sprinkler shown in FIG. 21, but showing the multi-nozzle shuttle and power actuator in mid-position, as it is transitioning from its first position to a second position.
Figure 23:
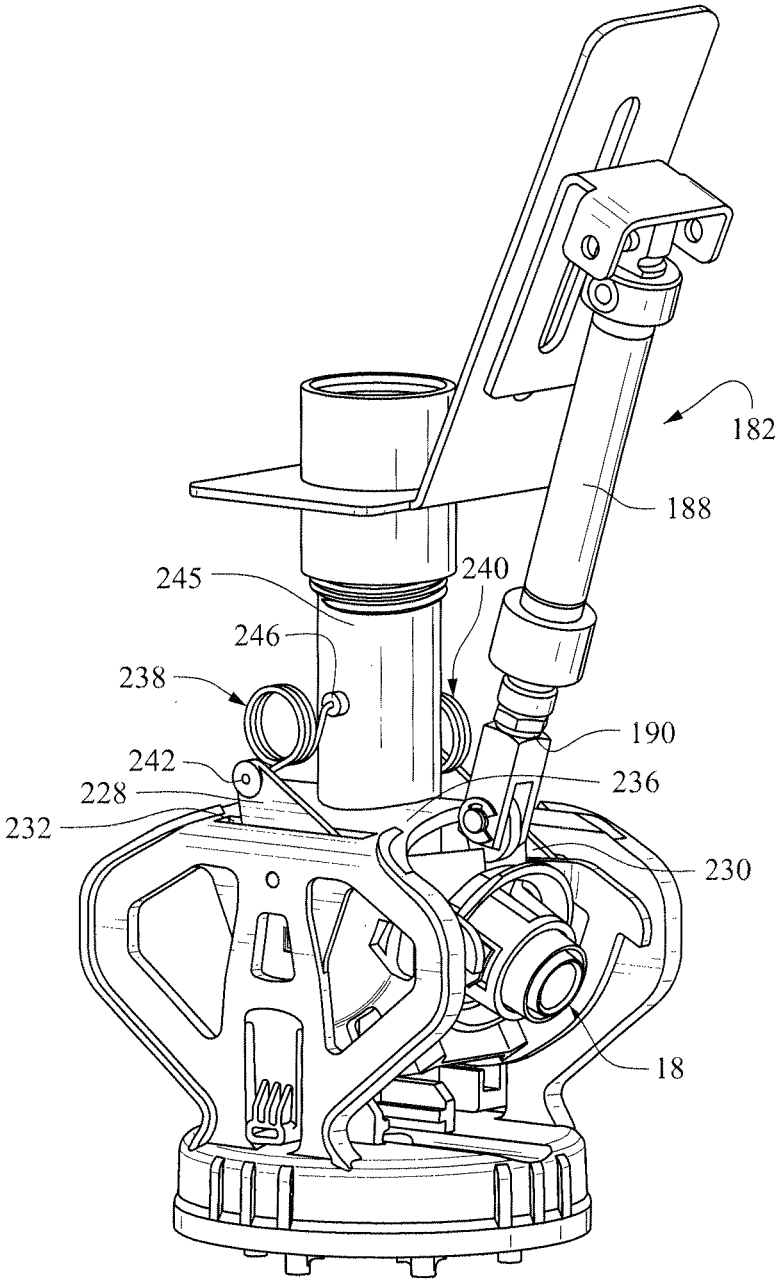
FIG. 23 is a perspective view of the sprinkler shown in FIGS. 21 and 22, but showing the multi-nozzle shuttle and power actuator in the second position.

In the case of the pneumatic cylinder 188 illustrated in the drawings, when the multi-nozzle shuttle 184 is moved to either of the two nozzle-installed positions, the air pressure exerted on the piston may be removed. It then might be beneficial to provide a mechanism for holding or retaining the shuttle in either of its two possible positions. FIGS. 21-23 illustrate an exemplary retention mechanism in the form of torsion springs extending between the movable multi-nozzle shuttle and the stationary sprinkler body. More specifically, as shown in FIG. 21, the upstanding arms 228 and 230 of the shuttle 184 are extended through slots 232, 234 in the top surface 236 of the sprinkler body to thereby provide attachment points for, in this exemplary but nonlimiting embodiment, a pair of coiled torsion springs 238, 240. One end of each torsion spring is inserted in openings 242, 244 respectively, at the ends of the arms 228, 230, while the other end of each torsion spring is received in respective bosses (one shown at 246) provided on opposite sides of an upwardly extended portion 245 of the sprinkler body. The bosses could also be provided on an adaptor or coupling attached to the sprinkler body. In FIG. 21, the nozzle 18 shown is in the installed position, while nozzle 16 is shown in an offset or inoperative position.

The torsion springs 238, 240 provide a holding force in the LO and HI nozzle-installed positions. Specifically, as the multi-nozzle shuttle 184 is rotated by the pneumatic cylinder 188, the extended arms 228, 230 rotate with the multi-nozzle shuttle 184. More tension is created in the torsion springs during this rotation until the center point, shown in FIG. 22, is passed (the center corresponds to the center or "OFF" position in the manually-operated shuttle embodiment). The tension reduces as the multi-nozzle shuttle approaches the HI or LO nozzle-installed position. There is enough tension remaining in the springs, however, to provide a force sufficient to keep the limit stops on the multi-nozzle shuttle (see stops 222, 224 in FIG. 18) in contact with the stops or tabs 106, 108 on the sprinkler body when air pressure is removed from the cylinder.

In FIG. 23, the multi-nozzle shuttle has rotated to the position where nozzle 18 is rotated out of the installed position, and nozzle 16 (not visible in FIG. 23) is rotated to the installed position.

Other retention spring arrangements are within the scope of the invention, and such spring arrangements, including the torsion spring arrangement described above, may be used in place of the retention tabs 106, 108 with or without a power actuator.

Figure 24:
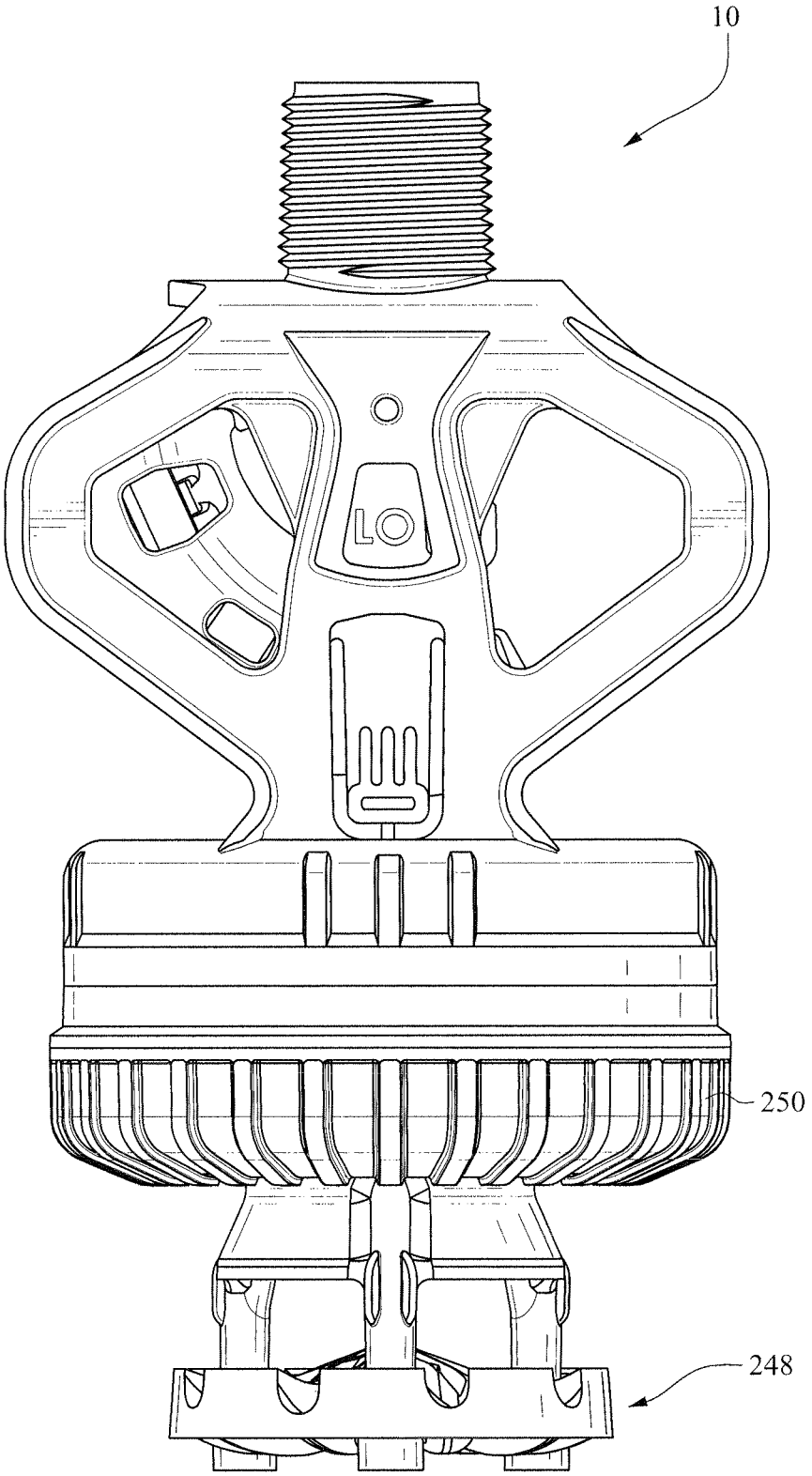
FIG. 24 is a side elevation of the sprinkler head shown in FIGS. 1-4 with a water distribution plate and optional weight attached, and with the other of the two nozzles in an installed position.
Figure 25:
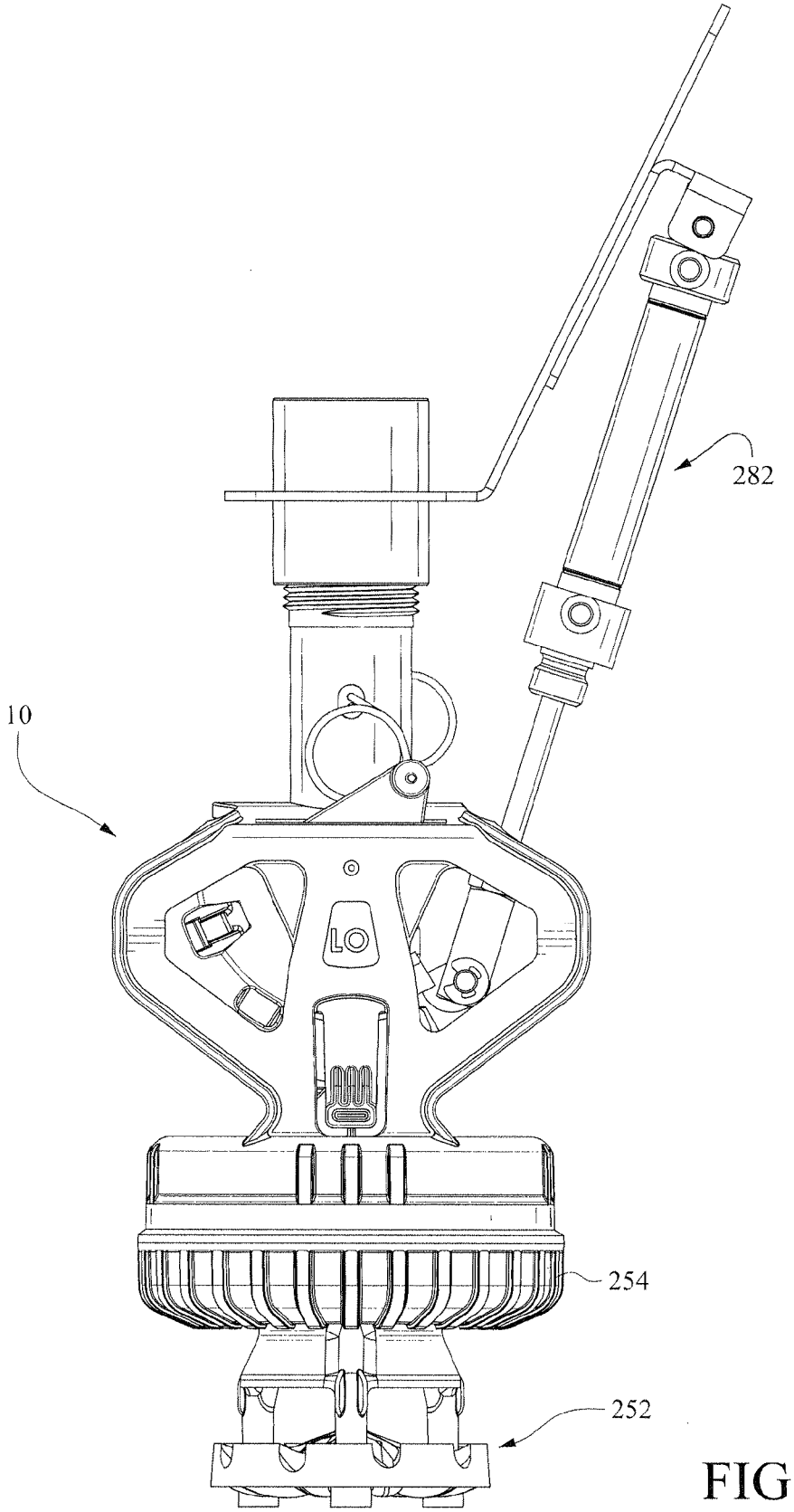
FIG. 25 is a side elevation of the sprinkler head shown in FIGS. 21-23 with a water distribution plate and optional weight attached.

If a water deflector plate and related support structure are employed, they may be of the type available from the assignee in a series of sprinklers known as Rotator® sprinklers, but the invention is not limited to use with any specific water deflector plate configuration. FIG. 24 shows the sprinkler head 10 with a water distribution plate 248 attached to the sprinkler head, with an optional weight 250 threaded onto the peripheral wall or skirt 38. This arrangement is known and need not be described in detail. A similar arrangement is shown in FIG. 25 where a similar water distribution plate 252 and optional weight 254 are secured at the same location on the power-actuated sprinkler head.

In addition, however, it will be understood that the invention is not limited to sprinklers incorporating any such deflector plates. In other words, the multi-nozzle shuttle as described herein can be used in other applications where the nozzle is shaped to provide the desired stream in the desired direction (rotating or nonrotating) without any downstream deflector plate.

Figure 26:
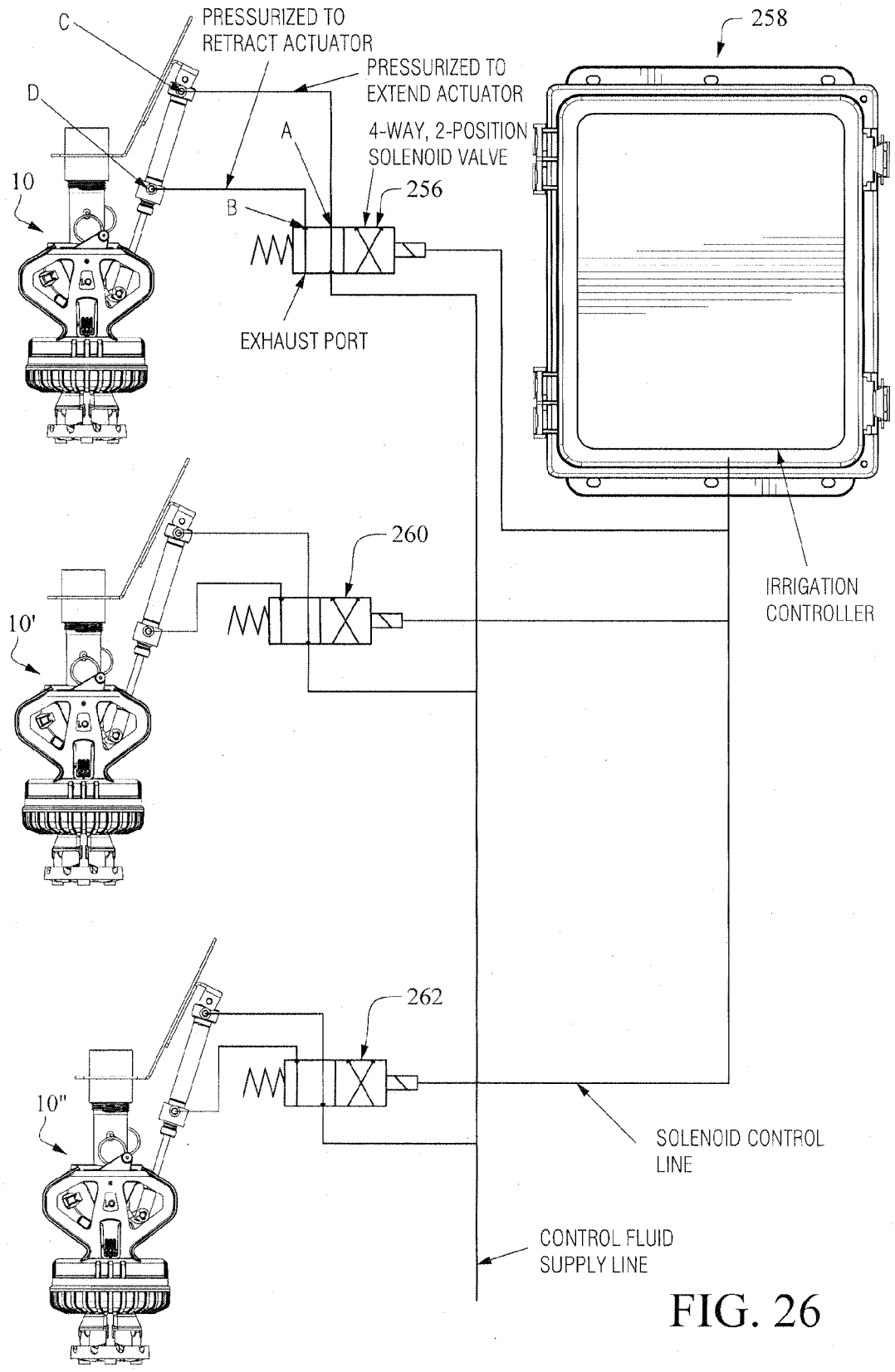
FIG. 26 is a schematic diagram showing an automated arrangement of multiple, power-actuated sprinkler heads controlled by a remote irrigation controller.

It will also be appreciated that the power actuator 182 may be ganged or otherwise synchronized with any number of like sprinkler heads, with actuation triggered locally or remotely by, for example, wireless communication with a controller incorporating a microprocessor programmed to achieve desired flow rates by changing nozzles in all or some selected group or groupings of sprinkler heads. Now with reference to FIG. 26, the power actuator 282 attached to the sprinkler head 10 is connected to a 4-way, 2-position solenoid valve 256. Port A of the solenoid valve is connected to Port C of the actuator. Port B of the solenoid valve is connected to Port D of the actuator. When the solenoid is energized in the first direction, Port A is connected to the incoming supply of control fluid. The control fluid flows through the valve to Port C of the actuator. The control fluid has sufficient pressure to extend the actuator which causes the multi-nozzle shuttle to rotate to one of the nozzle positions. Further, the control fluid is pushed out of Port D back through Port B. Port B is connected to exhaust port so the control fluid escapes through the exhaust port.

Energizing the solenoid in the second direction results in Port B being connected to the supply line of the control fluid. Fluid then flows from Port B to Port D. The control fluid has sufficient pressure to retract the actuator which results in the multi-nozzle shuttle rotating to another of the nozzle positions. Additionally, the control fluid is pushed back through Port C, then to Port A, then out of the exhaust port.

The microprocessor within the controller 258 contains a microprocessor that operates a watering schedule which may require variations in the flow rates of some or all of the sprinkler heads at different times. Per the schedule, the microprocessor sends commands individually to the solenoid valves 256, 260, 262, etc., associated with the sprinkler heads 10, 10', 10", etc. Thus, each actuator can be controlled independently to ensure that the correct nozzle is in the installed position in each sprinkler head. The controller 258 can communicate with each solenoid valve through discrete wire connections, through a 2-wire communication scheme or by a wireless system.

The power actuator 282 can also be replaced by an electrically-driven device such as a stepper motor or motor-driven ball and screw assembly. In this case, the irrigation controller may be connected directly to the motor.

To confirm that nozzles have been changed as intended, a plainly visible indicator or "flag" could be employed to eliminate the need to personally inspect each sprinkler head.

It will be further understood that any reference herein to terms such as forward, rearward, top, bottom, vertical, horizontal, left side or right side are for convenient reference purposes only, and are based on the sprinkler head orientation as shown in the various figures. The characterizations are not in any way to be considered limiting in the sense that the sprinkler heads disclosed herein may be oriented in any desired manner, depending on specific applications.

While the invention has been described in connection with what is presently considered to be the most practical and preferred embodiment, it is to be understood that the invention is not to be limited to the disclosed embodiment, but on the contrary, is intended to cover various modifications and equivalent arrangements.

What is claimed is:

1. A sprinkler head comprising:

a sprinkler body having a first flow passage defined by a bore having an inlet end and an outlet end; and a multi-nozzle shuttle supporting at least two nozzles and provided with openings aligned with second flow passages in said at least two nozzles, respectively; said multi-nozzle shuttle mounted on said sprinkler body for swinging pivotal movement between either of two nozzle-installed positions wherein one of said second flow passages in a selected one of said at least two nozzles is aligned with said first flow passage at said outlet end of said bore, wherein said multi-nozzle shuttle includes a shut-off surface located between said openings, and wherein said multi-nozzle shuttle is movable to a shut-off position where said shut-off surface engages said outlet end of said bore, wherein said sprinkler body includes a nozzle guide platform provided with a center opening axially aligned with said bore and a pair of laterally-spaced, upstanding guide ribs flanking said center opening for guiding each of said at least two nozzles into either of said two nozzle-installed positions.

2. A sprinkler head comprising:

a sprinkler body having a first flow passage defined by a bore having an inlet end and an outlet end; and a multi-nozzle shuttle supporting at least two nozzles and provided with openings aligned with second flow passages in said at least two nozzles, respectively; said multi-nozzle shuttle mounted on said sprinkler body for swinging pivotal movement between either of two nozzle-installed positions wherein one of said second flow passages in a selected one of said at least two nozzles is aligned with said first flow passage at said outlet end of said bore, wherein said multi-nozzle shuttle is supported on pivot pins received in pivot bosses provided on said sprinkler body and said multi-nozzle shuttle, respectively.

3. The sprinkler head of claim 1 wherein said multi-nozzle shuttle includes a nozzle support platform provided with a pair of nozzle holders on one side of said nozzle support platform aligned with said openings, and wherein said shut-off surface is on an opposite side of said nozzle support platform.

4. The sprinkler head of claim 3 wherein said outlet end of said bore is provided with a seal adapted to engage said shut-off surface when said multi-nozzle shuttle is in the nozzle shut-off position, and to seal about said openings when said multi-nozzle shuttle is in either of said nozzle-installed positions.

5. The sprinkler head of claim 1 wherein said multi-nozzle shuttle is releasably retained in at least said two nozzle-installed positions.

6. The sprinkler head of claim 1 wherein said at least two nozzles have different orifice diameters.

7. The sprinkler head of claim 3 wherein standards extend from said nozzle-guide platform and connect to an upstream end of said sprinkler body.

8. The sprinkler head of claim 7 wherein at least two of said standards are diametrically-opposed and comprise a center section and a pair of open-wing sections extending in opposite directions from said center section.

9. The sprinkler head of claim 8 wherein each of said diametrically-opposed standards is provided with a retention tab in said center section engageable within any of three notches provided in said multi-nozzle shuttle, said three notches located so as to correspond to said nozzle shut-off position and said two nozzle-installed positions.

10. A sprinkler head comprising:

a sprinkler body having a first flow passage defined by a bore having an inlet end and an outlet end; and a multi-nozzle shuttle including a nozzle support platform supporting a pair of nozzles on one side of said nozzle support platform, said multi-nozzle shuttle supported on said sprinkler body for swinging pivotal movement in one direction to a first nozzle-installed position where one of said pair of nozzles is aligned with said flow passage, and in an opposite direction to a second nozzle-installed position where the other of said pair of nozzles is aligned with said flow passage, wherein said multi-nozzle shuttle is provided with a shut-off surface between said pair of nozzles on an opposite side of said nozzle support platform, said multi-nozzle shuttle movable to a nozzle shut-off position between said first nozzle-installed position and second nozzle-installed position, and wherein said multi-nozzle shuttle is releasably retained in said nozzle shut-off position and in said first and second nozzle-installed positions, wherein said multi-nozzle shuttle is provided with a pair of nozzle holders on said one side thereof, said nozzle support platform provided with openings aligned with second flow passages, respectively, in said pair of nozzles, and each of said pair of nozzle holders comprises a support hub and at least two resilient support tabs radially spaced from said support hub.

11. A sprinkler head comprising:

a sprinkler body having a first flow passage defined by a bore having an inlet end and an outlet end; and a multi-nozzle shuttle including a nozzle support platform supporting a pair of nozzles on one side of said nozzle support platform, said multi-nozzle shuttle supported on said sprinkler body for swinging pivotal movement in one direction to a first nozzle-installed position where one of said pair of nozzles is aligned with said flow passage, and in an opposite direction to a second nozzle-installed position where the other of said pair of nozzles is aligned with said flow passage, wherein said sprinkler body includes a nozzle guide platform provided with an aperture aligned with said flow passage and a pair of laterally-spaced, upstanding ribs for guiding each of said pair of nozzles into said first and second nozzle-installed positions, respectively.

12. A sprinkler head comprising:

a sprinkler body having a first flow passage defined by a bore having an inlet end and an outlet end; and a multi-nozzle shuttle including a nozzle support platform supporting a pair of nozzles on one side of said nozzle support platform, said multi-nozzle shuttle supported on said sprinkler body for swinging pivotal movement in one direction to a first nozzle-installed position where one of said pair of nozzles is aligned with said flow passage, and in an opposite direction to a second nozzle-installed position where the other of said pair of nozzles is aligned with said flow passage, wherein said multi-nozzle shuttle is provided with laterally-spaced, upstanding ears formed to receive pivot pins extending between said upstanding ears and opposite sides of said sprinkler body.

13. The sprinkler head of claim 10 wherein a seal is provided at said outlet end of said bore, said seal adapted to engage said shut-off surface when said multi-nozzle shuttle is in said shut-off position, and to seal about said openings, respectively, when in either of said two nozzle-installed positions.

14. A sprinkler head comprising:

a sprinkler body having a center hub having a first flow passage defined by a bore having an inlet end and an outlet end;

a multi-nozzle shuttle adapted to support a pair of nozzles, said multi-nozzle shuttle supported on said center hub for pivoting movement about a horizontal axis between a nozzle shut-off position and either of two nozzle-installed positions, said shuttle provided with a nozzle support platform formed with a shut-off surface on an upper side of said nozzle support platform for shutting off flow through said bore when said multi-nozzle shuttle is moved to the nozzle shut-off position;

a pair of nozzle holders on an underside of said nozzle support platform; and a pair of positioning arms projecting below said nozzle support platform, said pair of positioning arms each formed on respective lower edges with three notches corresponding to said nozzle shut-off position and said two nozzle-installed positions, said three notches on each positioning arm adapted for selective engagement with a retention tab located on opposite sides of said sprinkler body.

15. The sprinkler head of claim 14 wherein said sprinkler body includes a nozzle guide platform provided with an aperture aligned with said bore, said nozzle guide platform connected to said center hub by a pair of diametrically-opposed standards, each standard supporting one of said retention tabs.

16. The sprinkler head of claim 15 wherein said standards are formed with open frames extending in opposite directions from respective center sections, said retention tabs located in said center sections.

17. A sprinkler head comprising:

a sprinkler body having a center hub including a first flow passage defined by a bore having an inlet end and an outlet end;

a multi-nozzle shuttle attached to said sprinkler body supporting first and second nozzles located downstream of said bore for swinging pivotal movement between at least a first nozzle-installed position where said first nozzle is aligned with said bore and a second nozzle-installed position where said second nozzle is aligned with said bore; and a power actuator arranged to move said multi-nozzle shuttle between at least said first nozzle-installed position and said second nozzle-installed position.

18. The sprinkler head of claim 17 wherein said power actuator comprises a pneumatic or hydraulic cylinder.

19. The sprinkler head of claim 17 wherein said power actuator comprises a solenoid or an electric motor.

20. The sprinkler head of claim 17 wherein said power actuator is a one-, two- or three-way actuator.

21. The sprinkler head of claim 17 wherein said power actuator is connected at one end to said multi-nozzle shuttle and at an opposite end to said center hub.

22. The sprinkler head of claim 21 wherein a bracket assembly extends between said center hub and said power actuator, and wherein said power actuator is pivotally connected to opposite ends of said bracket assembly.

23. The sprinkler head of claim 21 wherein one or more springs is connected between said sprinkler body and said multi-nozzle shuttle to hold said multi-nozzle in either of said first and second positions upon deactivation of said power actuator.

24. The sprinkler head of claim 17 wherein said power actuator is controlled by a microprocessor via wired or wireless communication.

25. The sprinkler head of any of claim 1, 10, 14 or 17 wherein said multi-nozzle shuttle is provided with flow-rate indicia visible to a user in either of the two nozzle-installed positions.

26. The sprinkler head of any of claim 1, 11 or 15 wherein said sprinkler body supports a water deflection plate downstream of said nozzle guide platform.

27. An irrigation system comprising:

a plurality of sprinkler heads supported on an irrigation apparatus and independently controlled by a controller, each sprinkler head comprising a sprinkler body formed with a first flow passage defined by a bore having an inlet end and an outlet end;

a multi-nozzle shuttle attached to said sprinkler body supporting first and second nozzles located downstream of said bore for swinging pivotal movement between at least a first nozzle-installed position where said first nozzle is aligned with said bore and a second nozzle-installed position where said second nozzle is aligned with said bore; and a power actuator connected between said sprinkler head and said multi-nozzle shuttle, said power actuator and an associated control valve operatively connected to the controller, said power actuator adapted to move said multi-nozzle shuttle between at least said first nozzle-installed position and said second nozzle-installed position in response to a command received from said controller.

* * * * *

UNITED STATES PATENT AND TRADEMARK OFFICE

CERTIFICATE OF CORRECTION

PATENT NO. : 9,095,859 B2
APPLICATION NO. : 13/776051
DATED : August 4, 2015
INVENTOR(S) : Sesser et al.

It is certified that error appears in the above-identified patent and that said Letters Patent is hereby corrected as shown below:

Title Page of Patent, Item (72) Inventors:

Delete "Craig M. Nelson" and insert therefor --Craig B. Nelson--.

Signed and Sealed this
Twenty-third Day of August, 2016

Michelle K. Lee

Michelle K. Lee
*Director of the United States Patent and Trademark Office*